US007580011B2

(12) United States Patent
Toyoshima et al.

(10) Patent No.: US 7,580,011 B2
(45) Date of Patent: Aug. 25, 2009

(54) CURRENT GENERATION SUPPLY CIRCUIT AND DISPLAY DEVICE

(75) Inventors: Tsuyoshi Toyoshima, Hino (JP); Tomoyuki Shirasaki, Higashiyamato (JP); Katsuhiko Morosawa, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 845 days.

(21) Appl. No.: 10/880,298

(22) Filed: Jun. 28, 2004

(65) Prior Publication Data

US 2005/0017931 A1 Jan. 27, 2005

(30) Foreign Application Priority Data

Jun. 30, 2003 (JP) ..... 2003-186270

(51) Int. Cl.
*G09G 3/06* (2006.01)

(52) U.S. Cl. ..... 345/76; 345/690

(58) Field of Classification Search ..... 345/76–77, 345/80, 82, 690

See application file for complete search history.

(56) References Cited

U.S. PATENT DOCUMENTS

| | | | |
|---|---|---|---|
| 6,266,000 | B1 | 7/2001 | Jusuf et al. |
| 6,323,631 | B1 | 11/2001 | Juang |
| 6,556,176 | B1 | 4/2003 | Okuyama et al. |
| 6,765,560 | B1 | 7/2004 | Ozawa |
| 6,882,186 | B2 | 4/2005 | Nishitoba |
| 7,012,597 | B2 | 3/2006 | Kasai |
| 7,091,937 | B2 | 8/2006 | Nakamura |
| 7,256,756 | B2 | 8/2007 | Abe |

(Continued)

FOREIGN PATENT DOCUMENTS

| | | | |
|---|---|---|---|
| CN | 1402208 | A | 3/2003 |

(Continued)

OTHER PUBLICATIONS

Related U.S. Appl. No. 10/891,904; filed Jul. 14, 2004; Applicants: Kazuhiro Sasaki et al; Title: Current Generation Supply Circuit and Display Device.

(Continued)

*Primary Examiner*—Amr Awad
*Assistant Examiner*—Michael Pervan
(74) *Attorney, Agent, or Firm*—Frishauf, Holtz, Goodman & Chick, P.C.

(57) ABSTRACT

A current generation supply circuit which supplies drive currents corresponding to digital signals for a plurality of loads comprising a current generation circuit which supplies output currents to the loads as the drive currents comprising a reference voltage generation circuit in which reference current having a constant current value is supplied and generates reference voltages based on the reference current; a drive current generation circuit which generates the output currents having current value ratios corresponding to the digital signals relative to the reference current based on the reference voltages; and a characteristic control circuit which sets the ratio of the output currents relative to the reference current. The characteristic control circuit sets the ratio of the output currents for the loads relative to the reference current in a plurality of stages or set so that the ratio of the output currents relative to the reference current can be altered for each of every load depending on the setting of the drive characteristic for each load.

62 Claims, 22 Drawing Sheets

U.S. PATENT DOCUMENTS

| | | | | |
|---|---|---|---|---|
| 2002/0021293 | A1 | 2/2002 | Tam | |
| 2002/0041276 | A1 | 4/2002 | Kimura | |
| 2002/0084812 | A1 | 7/2002 | Nishitoba | |
| 2002/0135314 | A1 | 9/2002 | Kitahara et al. | |
| 2003/0040149 | A1 | 2/2003 | Kasai | |
| 2003/0048669 | A1 | 3/2003 | Abe | |
| 2003/0058199 | A1 | 3/2003 | Kasai | |
| 2003/0128200 | A1 | 7/2003 | Yumoto | |
| 2003/0151616 | A1* | 8/2003 | Morita | 345/690 |
| 2004/0075621 | A1 | 4/2004 | Shiuan et al. | |
| 2004/0108998 | A1 | 6/2004 | Imamura | |
| 2004/0239668 | A1 | 12/2004 | Morosawa et al. | |
| 2004/0263437 | A1 | 12/2004 | Hattori | |
| 2005/0017765 | A1 | 1/2005 | Sasaki et al. | |
| 2005/0057580 | A1 | 3/2005 | Yamano et al. | |
| 2005/0157581 | A1 | 7/2005 | Shiurasaki et al. | |
| 2006/0139251 | A1 | 6/2006 | Morosawa et al. | |
| 2007/0217275 | A1 | 9/2007 | Abe | |

FOREIGN PATENT DOCUMENTS

| | | | |
|---|---|---|---|
| DE | 10028598 | A1 | 3/2001 |
| EP | 0365445 | A2 | 4/1990 |
| EP | 1039440 | A1 | 9/2000 |
| EP | 1182636 | A2 | 2/2002 |
| EP | 1 282 103 | A2 | 2/2003 |
| EP | 1 288 901 | A2 | 3/2003 |
| EP | 1333422 | A1 | 8/2003 |
| JP | 04-042619 | A | 2/1992 |
| JP | 7-202599 | A | 8/1995 |
| JP | 08-129359 | A | 5/1996 |
| JP | 10-93436 | A | 4/1998 |
| JP | 2000-105574 | A | 4/2000 |
| JP | 2000-122608 | A | 4/2000 |
| JP | 2000-340842 | A | 12/2000 |
| JP | 2002-140041 | A | 5/2002 |
| JP | 2002-202823 | A | 7/2002 |
| JP | 2003-122303 | A | 4/2003 |
| JP | 2003-150082 | A | 5/2003 |
| JP | 2003-150112 | A | 5/2003 |
| JP | 2003-150115 | A | 5/2003 |
| JP | 2003-195812 | A | 7/2003 |
| JP | 2003-195815 | A | 7/2003 |
| JP | 2003-308043 | A | 10/2003 |
| JP | 2004-037656 | A | 2/2004 |
| JP | 2004-054234 | A | 2/2004 |
| KR | 1988-0014748 | A | 12/1988 |
| KR | 2000-0073726 | A | 12/2000 |
| KR | 2001-0007609 | A | 1/2001 |
| WO | WO 01/006484 | A1 | 1/2001 |
| WO | WO 02/017289 | A1 | 2/2002 |
| WO | WO 02/039420 | A1 | 5/2002 |
| WO | WO 03/023752 | A1 | 3/2003 |
| WO | WO 03/027998 | A1 | 4/2003 |

OTHER PUBLICATIONS

Japanese Office Action dated May 26, 2008 issued in counterpart Japanese Application No. 2003-186270.

Goh, Joon-Chul, et al, "A New Pixel Circuit for Active Matrix Organic Light Emitting Diodes", IEEE Electron Device Letters, vol. 23, No. 9, Sep. 2002, pp. 544-546.

Tan, S.C. et al, "Designing of Circuit Building Blocks for OLED-on Silicon Microdisplays", SID, 2002 Digest, pp. 980-983, School of Electrical & Electronic Engineering, pp. 980-983.

Related U.S. Appl. No. 10/855,584; filed May 26, 2004; Inventors: Katsuhiko Morisawa et al; Title: Display Device and Method for Driving Display Device.

Related U.S. Appl. No. 10/891,904; filed Jul. 14, 2004; Inventors: Kazuhiro Sasaki et al; Title: Current Generation Supply Circuit and Display Device.

Related U.S. Appl. No. 10/532,889; filed Apr. 27, 2005; Inventors: Katsuhiko Morosawa et al; Title: Display Device and Method for Driving Display Device.

Japanese Office Action (and English translation thereof) dated May 27, 2008, issued in counterpart Japanese Application JP 2003-345876 of *related* U.S. Appl. No. 10/532,889.

Japanese Office Action (and English translation thereof) dated May 27, 2008, issued in counterpart Japanese Application JP 2003-103871 of *related* U.S. Appl. No. 10/532,889.

Japanese Office Action (and English translation thereof) dated Aug. 20, 2008, issued in counterpart Japanese Application JP 2003-345876 of *related* U.S. Appl. No. 10/532,889.

Japanese Office Action (and English translation thereof) dated Dec. 18, 2008, issued in counterpart Japanese Application JP 2003-186270.

Japanese Office Action (and English translation thereof) dated Aug. 20, 2008, issued in counterpart Japanese Application JP 2003-186270.

* cited by examiner

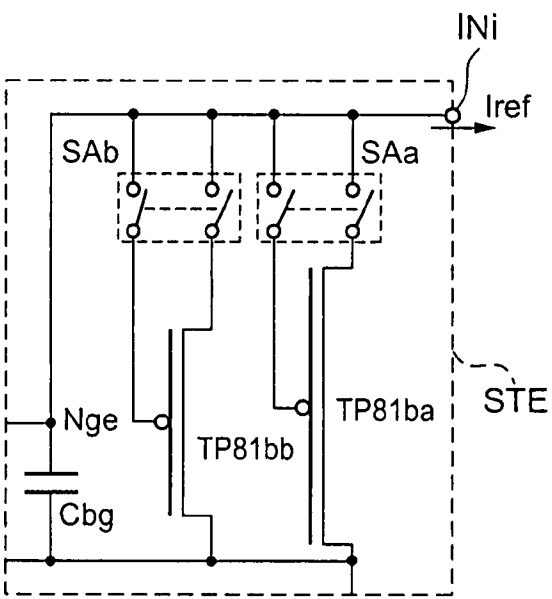
FIG. 22A
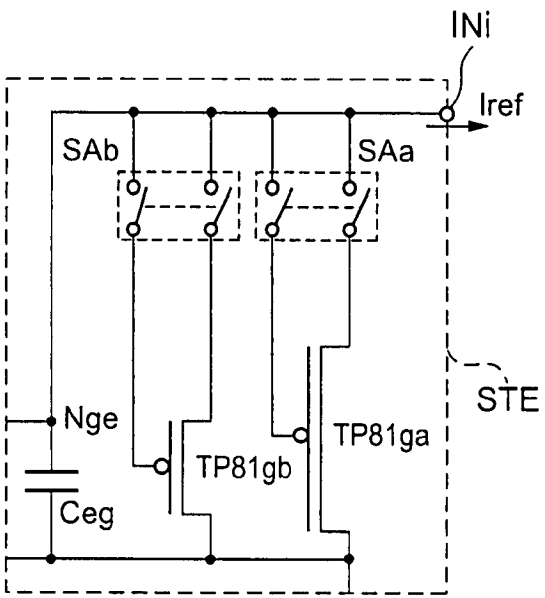
FIG. 22B
FIG. 22C

CURRENT GENERATION SUPPLY CIRCUIT AND DISPLAY DEVICE

CROSS-REFERENCE TO RELATED APPLICATION

This application is based upon and claims the benefit of priority from the prior Japanese Patent Application No. 2003-186270, filed Jun. 30, 2003, the entire contents of which is incorporated herein by reference.

BACKGROUND OF THE INVENTION

1. Field of the Invention

The present invention relates to a current generation supply circuit, a display device comprising the current generation supply circuit, and a drive method of the display device; and more particularly related to a current generation supply circuit applicable to driving a display panel comprised with display pixels having current control type light emitting devices and to the drive method of a driver circuit comprised with the current generation supply circuit.

2. Description of the Related Art

In recent years, as the next generation display device (display) following liquid crystal displays (LCD's), which are widely employed as monitors and displays for personal computers and video equipment, a display device which has a self-luminescent type display panel with optical devices (light emitting devices) arranged in matrix form consisting of self-luminescent type devices such as organic electroluminescent devices (hereinafter, referred to as "organic EL devices"), inorganic electroluminescent devices (hereinafter, referred to as "inorganic EL devices") or Light Emitting Diodes (LEDs) and the like are well known.

Particularly, in comparing the liquid crystal display with a self-luminescent type display device described above, the self-luminescent type display device in which an active matrix drive method is applied provides a more rapid display response speed and there is no viewing angle dependency. Furthermore, even higher luminosity and higher contrast along with highly detailed display images using low-power consumption and the like are practicable. Also, since backlight is not needed like a liquid crystal display, this very predominant feature will lead to more thin-shaped and lightweight models. Accordingly, Research and Development (R&D) of the self-luminescent type display device which further incorporates these features into functional use is actively being pursued.

This self-luminescent type display device according to such an active matrix drive method, in general, comprises a display panel with display pixels containing light emitting devices arranged near each of the intersecting points of the scanning lines positioned in rows and the data lines positioned in columns; a data driver which generates gradation currents corresponding to the image display signals (display data) to supply each of the display pixels via the data lines; and a scanning driver which sequentially applies scanning signals at predetermined timing and sets the display pixels in specified lines to a selection state. With the above-mentioned gradation currents supplied to the display pixels, each of the light emitting devices perform a light generation operation by predetermined luminosity gradations corresponding to the display data and the desired image information is displayed on the display panel. An illustrative example of the light emitting device type display will be explained later in the embodiments of the invention.

As for the drive methods in such a self-luminescent type display device, a voltage specification type drive method which controls the current values of the drive currents flowed to each of the light emitting devices to perform the light generation operation by predetermined luminosity through adjusting the voltage values of the gradation signal voltages applied by the data driver according to the display data relative to the display pixels of specified lines selected by the scanning driver; or a current specification type drive method which controls the current values of the drive currents flowed to each of the light emitting devices through adjusting the current values of the drive currents (gradation currents) supplied by the data driver are known.

However, the self-light generation type display device mentioned above has a drawback as described below.

Specifically, of the above-mentioned methods, the voltage specification type method has to comprise pixel driver circuits which convert the voltage component of the gradation signal voltages into the current component in each of the display pixels. Therefore, when the device characteristics, such as in the Thin-Film Transistors which constitute the pixel driver circuits, are fluctuated by the external environment or deteriorate with age, the transfer characteristic from the voltage component to the current component tends to be vulnerable to the influence of these characteristic variations. Thus, variations in the current values of the drive currents become larger and result in a troublesome problem of stably acquiring the desired luminosity characteristic over a long period of time.

Conversely, the current specification type drive method has an advantage which can suppress the influence of variations in device characteristics. However, for example, when drive currents according to the display data are generated and each of the display pixels are supplied via each of the data lines based on standard (reference) currents provided via a current supply source line from a predetermined current source, since the drive currents supplied via each of the data lines changes corresponding to the display data, the standard currents supplied from the predetermined current source will also change according to the display data. Here, as a capacity component (wiring capacity) commonly exists in the signal wiring, the operation which supplies standard currents via the current supply source line mentioned above is equivalent to the charging or discharging to predetermined electric potential the capacity component which exists in the current supply source line. As a result, when the standard currents supplied via the current supply source line are extremely low, the charge and discharge operation takes time and until the electric potential of the current supply source line is stabilized, a relatively lengthy period will be required. Here, although a high-speed operation is required in the operation of the data driver, as the number of display pixels increase in proportion to the increase in the number of data lines and scanning lines, the drive period for every scanning line decreases and the time assigned to generating drive currents for every data line becomes shorter. As stated above, a certain amount of time is required for the charge and discharge operation to the current supply source line which causes a problem in the speed of the charge and discharge operation and resultant rate limitation in the operating speed of the data driver. Furthermore, when displaying image information in color, generally, the desired luminescent colors are acquired by individually controlling the light generation luminosity of the light emitting devices for each color red (R), green (G) and blue (B) according to each color component contained in the display data. As described later, since the relationship of the light generation luminosity (current-luminosity characteristic) relative to the drive currents in the light emitting devices for each RGB color differs with each other, the current values of the standard currents have to be appropriately and separately controlled according to the data lines corresponding to each color of the light emitting devices. Therefore, the drive control for producing the color display becomes complicated. In particular, it is difficult to satisfactorily control the white balance which sets the light generation luminosity of the light emitting devices of each RGB color so that the display colors can be recognized favorably as white.

SUMMARY OF THE INVENTION

The present invention comprises a current generation supply circuit which supplies drive currents corresponding to digital signals to a plurality of loads and a driver circuit comprising the current generation supply circuit in a display device which displays image information on a display panel having current control type light emitting devices. The present invention provides an effect such that even when extremely low drive currents are supplied to the loads, the drive currents can be generated and supplied rapidly, the display response characteristics can be raised and power consumption can be reduced. Furthermore, another effect is that luminosity in the case of the white color display can be enhanced resulting in improvement of the display image quality.

The current generation supply circuit in the present invention for acquiring the abovementioned effects comprises a current generation circuit which supplies output currents to each of the plurality of loads as the drive currents, the current generation circuit comprising a reference voltage generation circuit which includes a plurality of reference current transistors having transistor sizes different from each other, wherein at least a reference current having a constant current value is supplied and the reference voltage generation circuit generates a plurality of reference voltages having different voltage values based on the reference current to each of the plurality of loads, a drive current generation circuit which generates the output currents having a ratio of current values corresponding to the digital signals relative to the reference current based on the reference voltages, and a characteristic control circuit which includes a changeover switch that selectively flows the reference current to one of the plurality of reference current transistors and which sets the ratio of the output currents relative to the reference current in a plurality of stages by the changeover switch.

According to the present invention, the current generation circuit sets in order to flow the drive currents in a direction from a side of the loads or sets in order to flow the drive currents in a direction to a side of the loads.

Furthermore, the reference voltage generation circuit comprises a plurality of reference current transistors of which the transistor size of each other differs and by which the reference current flows to generate reference voltages different with each other corresponding to the reference current; and the characteristic control circuit comprises a changeover switch which selectively flows the reference current to one reference current transistor in the plurality of reference current transistors which sets the ratio of the output currents relative to the reference current in a plurality of stages.

According to the present invention, the reference voltage generation circuit comprises a plurality of reference current transistors in which the transistor size of each other differs and the reference current flows and which generate reference voltages different with each other corresponding to the reference current; and the characteristic control circuit comprises a changeover switch which selectively flows the reference current to one reference current transistor in the plurality of reference current transistors and sets the ratio of the output currents relative to the reference current in a plurality of stages.

Additionally, the reference voltage generation circuit comprises a charge storage circuit which stores electrical charges corresponding to the current value of the reference current and comprises a refresh circuit which refreshes a charge amount accumulated in the charge storage circuit to a charge amount corresponding to the reference current at each predetermined timing. The drive current generation circuit comprises a module current generation circuit which generates a plurality of module currents having a ratio of current values different from each other relative to the reference current based on the reference voltages and a current selection circuit which selectively integrates the plurality of module currents and generates the output currents and each current value of the plurality of module currents. The module current generation circuit comprises a plurality of module current transistors having transistor sizes different from each other and with each control terminal connected in common and each channel width has a ratio different from each other defined by $2^n$. Also, each control terminal is connected to a control terminal of each of the reference current transistors; and the reference current transistors and the module current transistors are comprised by a current mirror circuit. Moreover, the current selection circuit comprises a selection switch which selectively integrates the plurality of module currents and generates the output currents.

According to the present invention, the current generation supply circuit comprises a signal holding circuit which holds each bit value of the digital signals, wherein the drive current generation circuit generates the output currents corresponding to the bit values of the digital signals held in the signal holding circuit.

In order to obtain the abovementioned effects, a display device according to the present invention comprises a display panel comprising a plurality of scanning lines and a plurality of signal lines which intersect perpendicularly with each other and a plurality of display pixels arranged in matrix form near intersecting points of the scanning lines and the signal lines; a scanning driver circuit which sequentially applies a scanning signal to each of the plurality of scanning lines for setting the plurality of display pixels in a selection state a line at a time; and a signal driver circuit comprising a plurality of gradation current generation supply circuits which supply output currents as gradation currents to the plurality of display pixels set in the selection state via each of the signal lines, wherein each of the plurality of gradation current generation supply circuits comprises a current generation circuit comprising: a reference voltage generation circuit which includes a plurality of reference current transistors having different transistor sizes from each other, wherein at least a reference current having a constant current value is supplied and the reference voltage generation circuit generates a plurality of reference voltages having different voltage values based on the reference current to each of the plurality of signal lines; a drive current generation circuit which generates the output currents having a ratio of current values corresponding to gradation values of the display signals relative to the reference current based on the reference voltages; and a characteristic control circuit which includes a changeover switch that selectively flows the reference curent to one of the plurality of reference current transistors and which sets the ratio of the output currents relative to the reference current in a plurality of stages by the changeover switch.

The current generation circuit sets in order to flow the gradation currents in a direction from a side of the display pixels via the signal lines or sets in order to flow the gradation currents in a direction to a side of the display pixels via the signal lines.

The characteristic control circuit in the reference voltage generation circuit comprises a plurality of reference current transistors of which the transistor size of each other differs and by which the reference current flows to generate reference voltages different with each other corresponding to the reference current and comprises a changeover switch which selectively flows the reference current to one reference current transistor in the plurality of reference current transistors and sets the ratio of the output currents relative to the reference current in a plurality of stages or else the reference voltage generation circuit comprises one reference current transistor and set so that the transistor size of the reference current transistors are different from each other in the reference voltage generation circuit of the gradation current generation supply circuit corresponding to each of the light emitting devices. Furthermore, the characteristic control circuit sets the ratio of the output currents relative to the reference current so that the light generation luminosity of the luminescent colors red, green and blue of the light emitting devices have predetermined white balance, for example, the maximum gradation values of the display signals.

The reference voltage generation circuit comprises with a charge storage circuit which stores electrical charges corresponding to the current value of the reference current and also comprises a refresh circuit which refreshes the charge amount accumulated in the charge storage circuit to the charge amount corresponding to the reference current at each predetermined timing.

The drive current generation circuit comprises a module current generation circuit which generates a plurality of module currents having a ratio of current values different from each other relative to the reference current based on the reference voltages and a current selection circuit which selectively integrates the plurality of module currents and generates the output currents and each current value of the plurality of module currents. The module current generation circuit comprises a plurality of module current transistors having transistor sizes different from each other differs and with each control terminal connected in common and each channel width has a ratio different with each other defined by $2^n$. Also, each control terminal is connected to a control terminal of each of the reference current transistors; and the reference current transistors and the module current transistors are comprised by a current mirror circuit. Moreover, the current selection circuit comprises a selection switch which selectively integrates the plurality of module currents and generates the output currents.

Also, each of the gradation current generation supply circuits comprises a signal holding circuit which holds each bit value of the display signals derived from the digital signals, and the drive current generation circuit generates the output currents corresponding to the bit values of the display signals held in the signal holding circuit.

In the signal driver circuit, two or a plurality of current generation supply circuits are arranged in parallel relative to each of the signal lines and execute alternately in parallel (i) an operation that generates the output currents based on the bit values of the display signals held in the signal holding circuits in the drive current generation circuits of a first section of the gradation current generation supply circuits and (ii) an operation which successively holds bit values of the display signals in the signal holding circuits of a second section of the gradation current generation supply circuits.

The display pixels comprise current control type light emitting devices which performs a light generation operation by predetermined luminosity gradations corresponding to the current values of the gradation currents, for example, organic electroluminescent devices.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIGS. 22A, 22B and 22C are circuit diagrams showing the principal part of the reference voltage generation circuit applicable to the gradation current generation supply circuit related to the embodiments.

DETAILED DESCRIPTION OF THE INVENTION

Hereinafter, the current generation supply circuit and the control method related to the present invention as well as the display device comprised with the current generation supply circuit and the drive method of the display device will be explained in detail as shown in the embodiments.

Firstly, the current generation supply circuit related to the present invention and the control method will be described with reference to the drawings.

Figure 1A:
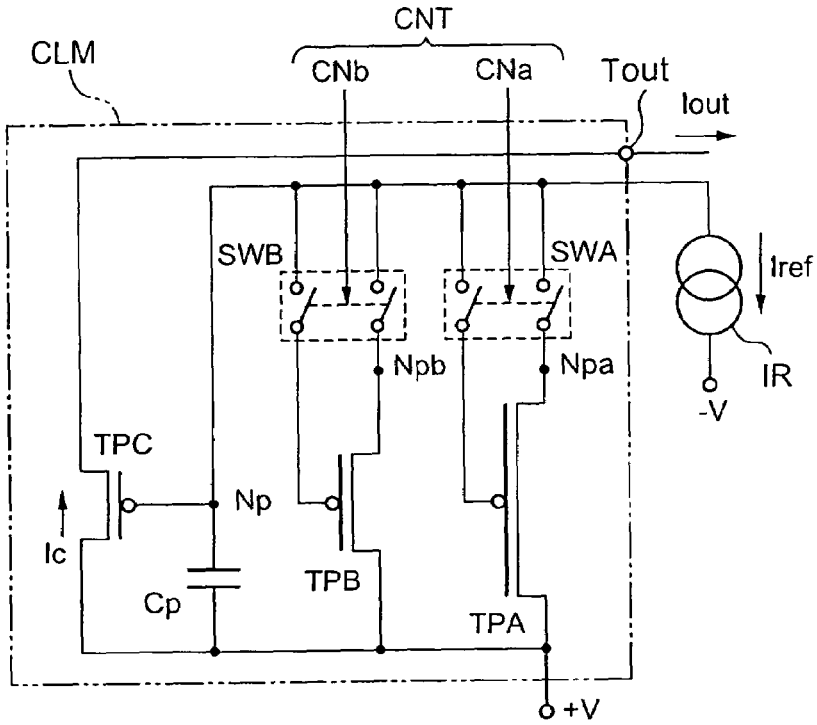
FIGS. 1A and 1B are configuration diagrams showing the basic configuration of the current generation circuit in an embodiment of the current generation supply circuit related to the present invention.
Figure 1B:
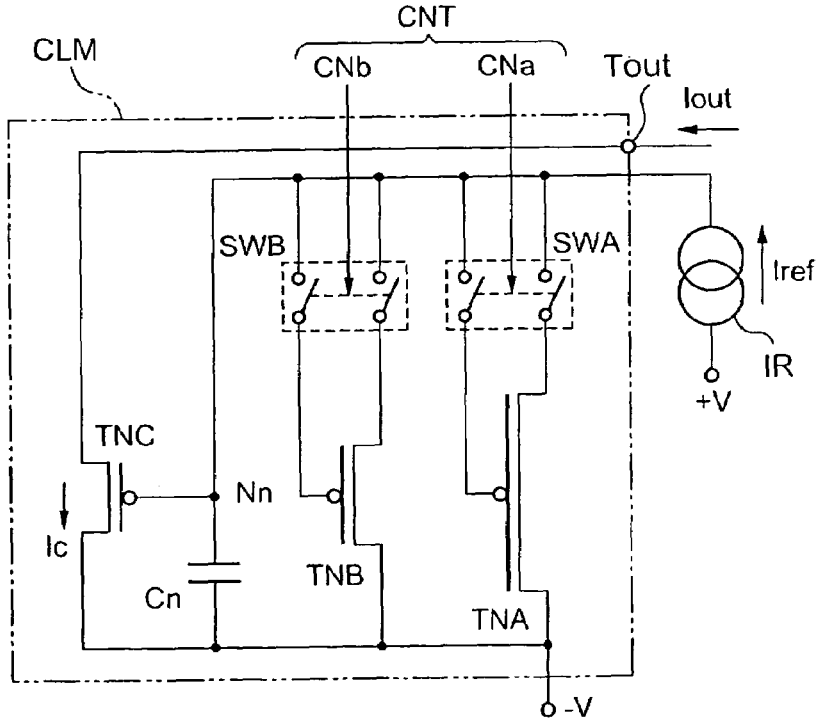

FIGS. 1A and 1B are configuration diagrams showing the basic configuration of the current generation circuit in an embodiment of the current generation supply circuit related to the present invention.

A current generation circuit CLM related to the embodiment as shown in FIG. 1A comprises a circuit configuration consisting of p-channel type Field Effect Transistors TPA (hereinafter, referred to as "p-channel type transistor") which has a current path (source-drain) between a high potential power supply +V and a contact Npa; a switch SWA that controls the connection state (continuity condition) among the contact Npa, the control terminal (gate terminal) of the p-channel type transistor TPA and contact Np; a p-channel type transistor TPB having a current path between the high potential power supply +V and contact Npb; a switch SWB that controls the connection state among the contact Npb, the control terminal of the p-channel type transistor TPB and the contact Np; and a capacitor (charge storage circuit) Cp connected between the contact Np and the high potential power supply +V, between the contact Np and a low potential power supply (for example, grounding potential) −V, a constant current generation source (constant current source) IR which supplies the reference current Iref having a constant current value is connected to generate predetermined voltages (reference voltages) corresponding to the reference current Iref on the contact Np; and a circuit configuration including a p-channel type transistor TPC (output current transistor) of which the current path is connected between the high potential power supply +V and an output terminal Tout, and the control terminal is connected to the contact Np to generate output currents Iout having predetermined ratios relative to the reference current Iref based on the reference voltages. The circuit configuration is provided with the Field Effect Transistors TPA, TPB and a capacitor Cp to generate the reference voltages corresponds to the reference voltage generation circuit in the invention. The circuit configuration is provided with the Field Effect Transistor TPC to generate the output currents Iout corresponds to a current generation circuit in the present invention.

Here, the p-channel type transistors TPA and TPB (reference current transistors) are arranged so as to have a channel width respectively different from each other. The switches SWA and SWB (changeover switches) are arranged so as to be controlled to set either one to a continuity condition based on the control signals CNT (switching control signals CNa and CNb) which are supplied from an external control section, to selectively connect the gate terminal and the current path of either one of the p-channel type transistors TPA and TPB to the contact Np corresponding to the characteristic control circuit in the invention.

Here, in this embodiment, one end of the p-channel type transistors TPA and TPB, the high potential power supply +V is connected and to the other end of the constant current generation source IR the low potential power supply-V is connected. Thereby, as described later, the reference current Iref flow in the direction drawn from the side of the high potential power supply +V, the p-channel type transistors TPA and TPB to the constant current generation source IR.

Also, in this embodiment, the following configuration is shown. That is, between the high potential power supply +V and the contact Np (or, the constant current generation source IR), the circuit which comprises the p-channel type transistor TPA and the switch SWA, and the circuit which comprises the p-channel type transistor TPB and the switch SWB are connected in parallel to each other. The present invention is not limited to the above. Such configuration that a plurality of circuits more than two formations are connected in parallel to each other maybe employed.

Owing to this, based on the control signal CNT, either one of the p-channel type transistors TPA and TPB is connected electrically between the high potential power supply +V and the contact Np, the reference current Iref having a constant current value is supplied to the p-channel type transistor by the constant current generation source IR. Thereby, on each gate terminal (contact Np), constant voltages (reference voltages) corresponding to the above reference current Iref and the channel width of the p-channel type transistors TPA or TPB is generated and applied to the gate terminal of the p-channel type transistor TPC.

Here, the p-channel type transistor TPA or TPB and the p-channel type transistor TPC form a current mirror circuit and the p-channel type transistors TPA and TPB are arranged so as to have a channel width respectively different from each other. Accordingly, corresponding to the continuity condition of the switches SWA and SWB, the voltage component generated on the contact Np is acquired in two different voltage values. Owing to this, corresponding to the voltage value generated on the contact Np, the continuity condition of the p-channel type transistor TPC is controlled, and thus, the currents Iout which are output from the high potential power supply +V through the p-channel type transistor TPC and the output terminal Tout are set to two different current values. That is, it is possible to set two different ratios (drive characteristic) which specify the current values of the output currents Iout relative to the constant reference current Iref.

Also, in the above-described FIG. 1A, a configuration such that the output currents Iout are supplied by flowing in from the current generation supply circuit (hereinafter, for convenience, referred to as "current application method") is employed. However, the invention is not limited to the above. As shown in FIG. 1B, a configuration such that the output currents Iout are supplied by being drawn in the direction of the current generation supply circuit (hereinafter, for convenience, referred to as "current sink method") may be employed. In this case, as shown in FIG. 1B, in the current generation supply circuit CLM shown in FIG. 1A, in place of the p-channel type transistors TPA-TPC, n-channel type Field Effect Transistors TNA-TNC (n-channel type transistor) may be employed. And a configuration such that, to the other end of the constant current generation source IR, the high potential power supply +V is connected, and the one end of the n-channel type transistors TNA-TNC are connected to the low potential power supply −V so that the reference current Iref is supplied by being flowed into the current generation supply circuit CLM from the constant current generation source IR may be employed.

<The First Embodiment of the Current Generation Supply Circuit>

Figure 2A:
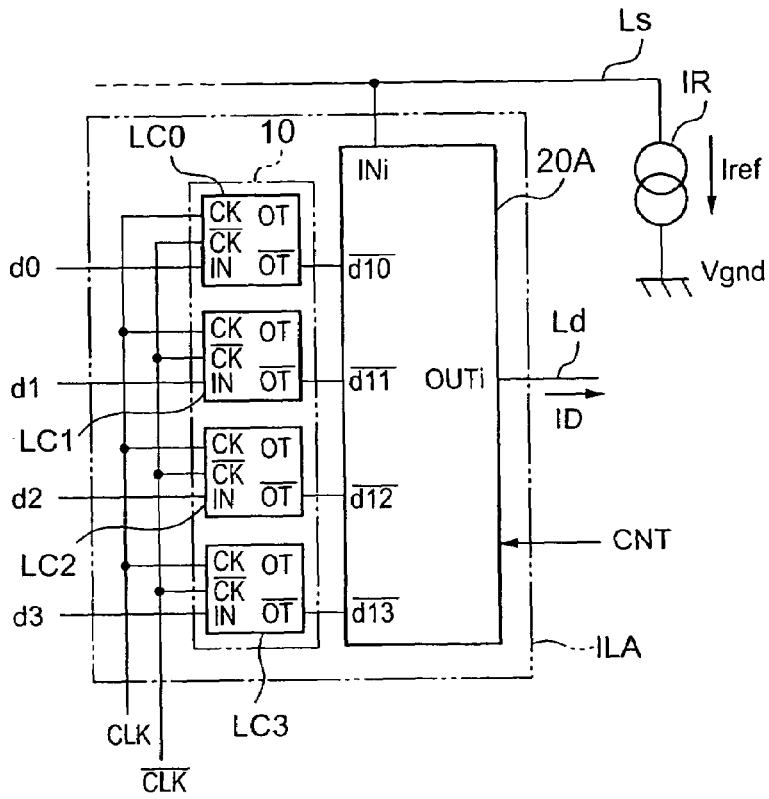
FIGS. 2A and 2B are configuration diagrams showing the first embodiment of the current generation supply circuit related to the present invention.
Figure 2B:
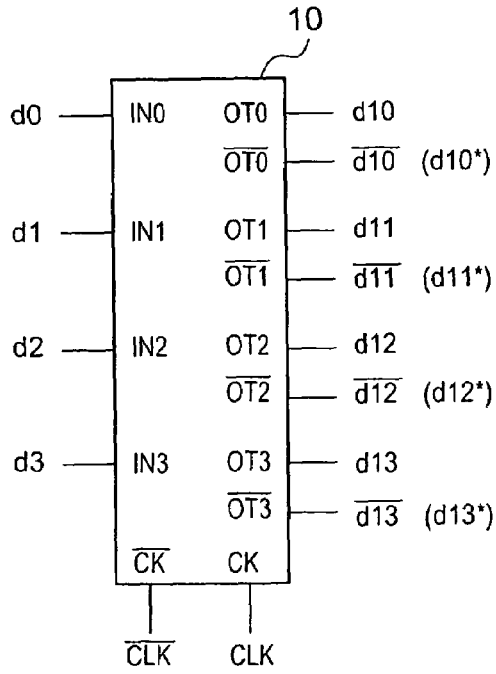

FIGS. 2A and 2B are configuration diagrams showing the first embodiment of the current generation supply circuit related to the present invention.

Here, as for the configuration, which is equivalent to that of the above-described embodiment shown in FIG. 1A, the same or equivalent reference numerals and symbols will be given thereto and the description therefore will be omitted.

As shown in FIG. 2A, the current generation supply circuit ILA related to this embodiment comprises the following circuits; i.e., a data latch section 10 (signal holding circuit) having latch circuits LC0, LC1, LC2 and LC3 (LC0-LC3) that separately take in and hold digital signals which are comprised of a plurality of bits d0, d1, d2 and d3 (d0-d3) (in this embodiment, a case of 4 bits is shown) for specifying the current values, and a current generation circuit 20A that takes in the reference current Iref having a constant current value which is supplied through the reference current supply line Ls from the constant current generation source (constant current source) IR and based on the output signals (inverted output signals) d10*, d11*, d12* and d13* (d10*-d13*; hereinafter, in this specification, for convenience, the inverted output signals are indicated using "*" which is the symbol representing the inverted polarity), which are output from the above-mentioned data latch section 10 (each of the latch circuits LC0-LC3), generates the drive currents ID having current values of predetermined ratios relative to the reference current Iref and outputs the drive currents ID to the loads through the drive current supply line Ld. Here, in this embodiment the other end of the constant current generation source IR is connected to the low potential power supply Vgnd (ground potential) so that the reference current Iref flows by being drawn from the drive current generation circuit 20A.

In this specification, the configuration of the data latch section 10 shown in FIG. 2A is, for convenience, is represented using the circuit symbols shown in FIG. 2B. In FIG. 2B, IN0-IN3 represent input contacts IN of latch circuits LC0-LC3 shown in FIG. 2A, respectively; OT0-OT3 represent non-inverted output contacts OT of the latch circuits LC0-LC3, respectively; and OT0*-OT3* represent inverted output contacts OT* of the latch circuits LC0-LC3, respectively.

Hereinafter, the above-mentioned configurations will be described in detail.

(Data Latch Section)

As shown in FIG. 2A, the data latch section 10 has such configuration that a plurality of latch circuits LC0-LC3 corresponding to the number of bits (4 bits) of the digital signals d0-d3 are provided in parallel. Based on the timing control signals CLK (non-inverted clock signals) and CLK* (inverted clock signals) which are output from an external timing generator, shift resister and the like at timing such that the timing control signals CLK are high-level (CLK* are low-level), the above-mentioned digital signals d0-d3, which are supplied separately respectively, are taken in simultaneously. And at timing such that timing control signals CLK are low-level (CLK* are high-level), the operation to output and hold the signal levels (non-inverted levels and inverted levels) based on the taken digital signals d0-d3 (signal holding operation) is carried out.

(Current Generation Circuit)

Figure 3:
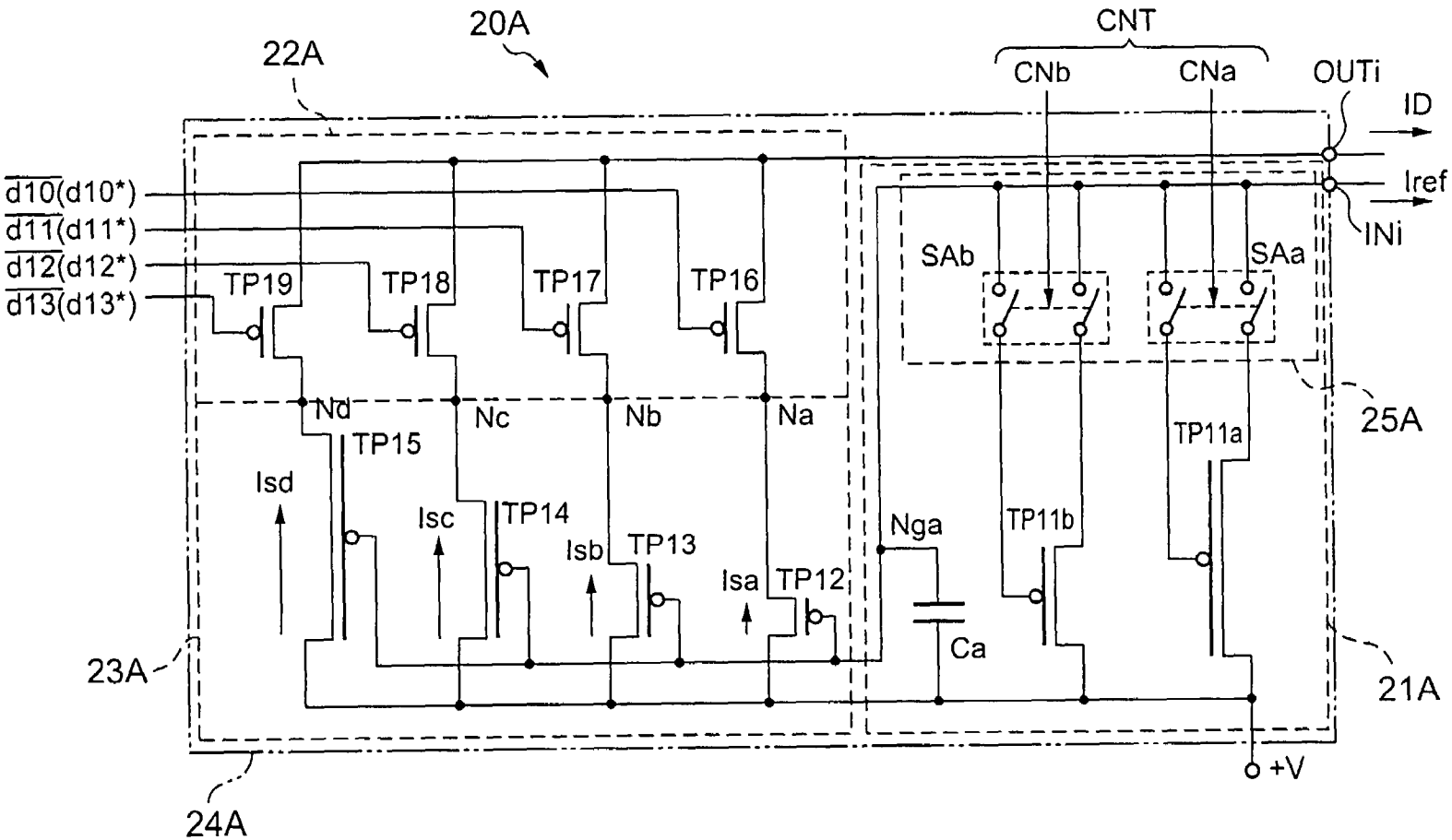
FIG. 3 is a circuit configuration diagram showing an illustrative example of the current generation circuit in the current generation supply circuit related to the present embodiment.

FIG. 3 is a circuit configuration diagram showing an illustrative example of the current generation circuit in the current generation supply circuit related to the present embodiment.

Figure 4:
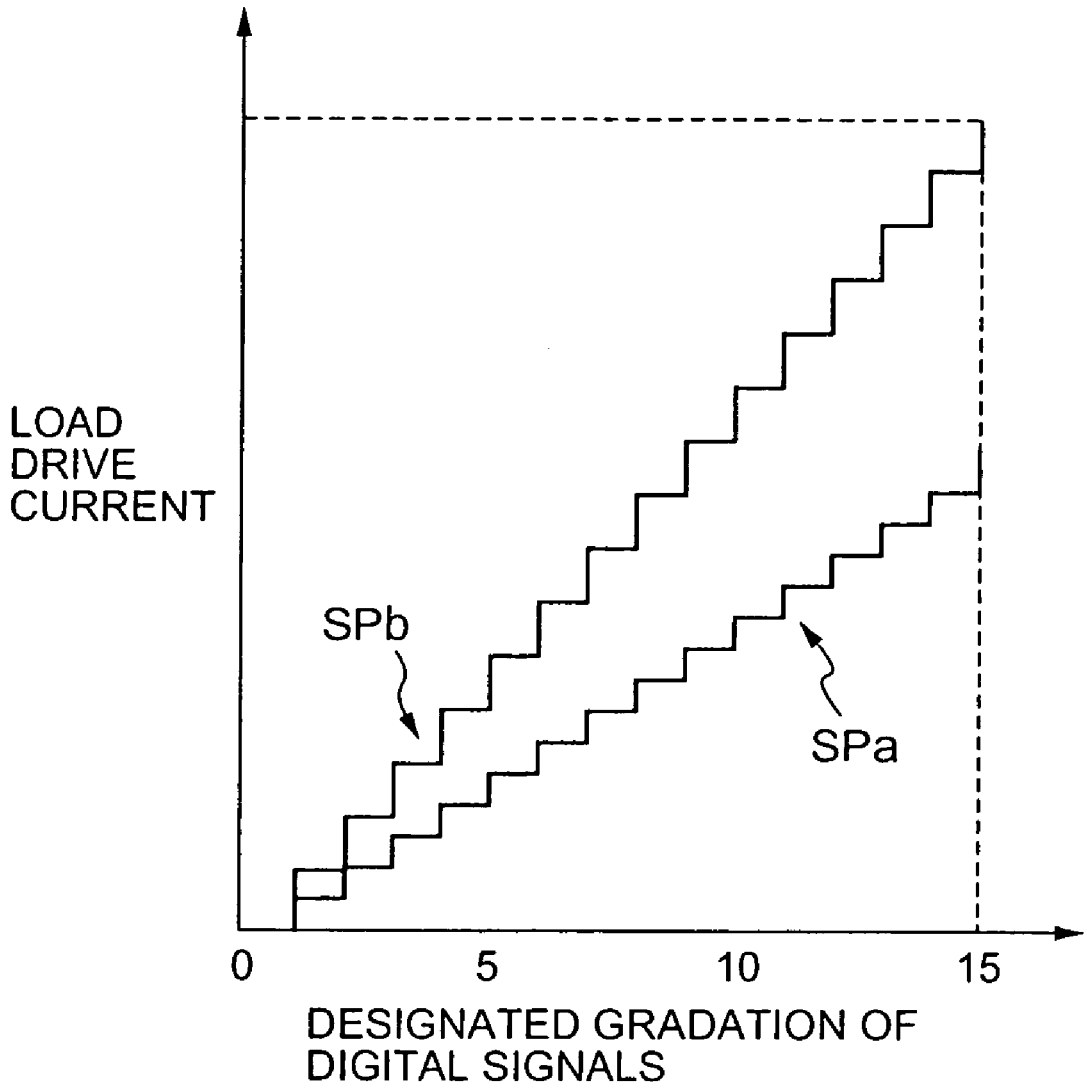
FIG. 4 is a diagram showing an example of the current characteristic (gradation-current characteristic) relative to the specified gradations in the current generation supply circuit related to the embodiments.

FIG. 4 is a diagram showing an example of the current characteristic (gradation-current characteristic) relative to the specified gradations in the current generation supply circuit related to the embodiments.

As shown in FIG. 3, the current generation circuit 20A comprises a reference voltage generation circuit 21A that generates reference voltage corresponding to the reference current Iref, a module current generation circuit 23A that, relative to the reference current Iref, generates a plurality of module currents Isa, Isb, Isc and Isd (Isa-Isd) each having current value ratios different from each other, and a current selection circuit 22A that selects a random module currents from the above-mentioned plurality of module currents Isa-Isd based on the output signals (inverted output signals) d10*-d13* (signal level of inverted output contacts OT0*-OT3* shown in FIG. 2), which are output from each of the latch circuits LC0-LC3 in the above-mentioned data latch section 10, and generates the drive currents ID. Here, the module current generation circuit 23A and the current selection circuit 22A constitute a drive current generation circuit 24A.

To be more precise, the reference voltage generation circuit 21A has a configuration equivalent to that of the circuit, which is comprised of the p-channel type transistors TPA and TPB, the switches SWA and SWB and the capacitor Cp in the above-described current generation supply circuit CLM shown in FIG. 1A. That is, the reference voltage generation circuit 21A has the following configuration; i.e., between the current input contact INi (contact Nga), to which the reference current Iref is supplied (drawn) from the constant current generation source IR through the reference current supply line Ls, and the high potential power supply +V, a circuit, which has a reference current transistor TP11*a* comprised of the p-channel type transistor and switch SAa and a circuit, which has a reference current transistor TP11*b* comprised of the p-channel type transistor and the switch SAb are connected respectively in parallel. And between the contact Nga, to which the current input contact INi is connected, and the high potential power supply +V, acapacitor (charge storage circuit) Ca is connected to generate a predetermined voltages (reference voltages) to the contact Nga corresponding to the reference current Iref. Here, the current path and control terminal (gate) of the p-channel type transistor TP11*a* are connected to the current input contact INi and contact Nga via the switch SAa, of which continuity condition is controlled by the switching control signals CNa in the control signals CNT.

Also, the current path and control terminal (gate) of the p-channel type transistor TP11*b* are connected to the current input contact INi and contact Nga via the switch SAb of which continuity condition is controlled by the switching control signals CNb in the control signals CNT. Thus, it is arranged so that the reference current Iref is supplied to either one of the p-channel type transistors TP11*a* or TP11*b* corresponding to the control signals CNT (switching control signals CNa and CNb). The switches SAa and SAb, of which the continuity condition is controlled by the control signals CNT, constitute the characteristic control circuit 25A.

To be more precise, the module current generation circuit 23A has a configuration such that, between each of the contacts Na, Nb, NC and Nd and the high potential power supply +V, the current paths are connected in parallel, and each of the control terminals are connected in common with the above-mentioned contact Nga, and module current transistors TP12, TP13, TP14 and TP15 (TP12-TP15), which are comprised of p-channel type transistors having a predetermined channel width respectively are provided. Here, the module current transistors TP12-TP15, which will be described later, are formed so that the transistor size thereof is different from each other at predetermined ratios. In FIG. 3, the relationship in transistor size of the Field Effect Transistors constituting the current mirror circuit 21A is conceptually shown for convenience by altering the width of the circuit symbols of the transistors.

The current selection circuit 22A has a configuration such that, between a current output terminal OUTi, to which the loads are connected, and each of the above-mentioned contacts Na, Nb, Nc and Nd, a current path is connected, and provided with switching transistors (selection switch) TP16, TP17, TP18 and TP19 (TP16-TP19) comprised of a plurality of p-channel type transistors (4 pieces), of which control terminals are applied with output signals (inverted output signals) d10*-d13* output from each of the latch circuits LC0-LC3 in the above-described data latch section 10 in parallel.

In the current generation circuit 20A related to this embodiment, it is arranged so that each of the module currents Isa-Isd, which flow through each of the module current transistors TP12-TP15 constituting the module current generation circuit 23A, have current values with predetermined ratios different from each other relative to the constant reference current Iref, which flow to the reference voltage generation circuit 21A.

To be more precise, when the transistor size of each of the module current transistors TP12-TP15 has a ratio different from each other; i.e., for example, in the Field Effect Transistors constituting each of the module current transistors TP12-TP15, when the channel length is constant, it is arranged so that the ratio of each of the channel width is W12:W13:W14:W15=1:2:4:8. Here, W12 represents channel width of the module current transistor TP12; W13 represents channel width of the module current transistor TP13; W14 represents channel width of the module current transistor TP14; and W15 represents channel width of the module current transistor TP15.

Owing to this, assuming that the channel width of either one of the reference current transistors TP11*a* or TP11*b* in the reference voltage generation circuit 21A is W11, the current value of the module currents Isa-Isd, which flow through each of the module current transistor TP12-TP15, are set to Isa=(W12/W11)×Iref, Isb=(W13/W11)×Iref, Isc=(W14/W11)×Iref, Isd=(W15/W11)×Iref, respectively. Accordingly, by arranging the channel width of the module current transistors TP12-TP15 to become a relationship defined as $2^n$ (n=0, 1, 2, 3, . . . ; $2^n$=1, 2, 4, 8, . . . ), the current values among the module currents Isa-Isd can be set to the ratio defined by $2^n$.

Here, in the current generation circuit 20A related to this embodiment, the reference voltage generation circuit 21A has a configuration such that the reference current transistors TP11*a*, TP11*b* are provided to two formations each having a channel width different from each other. Accordingly, corresponding to the control signal CNT, by selectively switching the reference current transistors TP11*a* or TP11*b*, which constitutes the reference voltage generation circuit 21A, by means of the switches SAa and SAb in the characteristic control circuit 25A, two different current values of the module currents Isa-Isd, which are generated by the module current transistors TP12-TP15 can be set.

And, using each of the module currents Isa-Isd in which the current value has been set as described above, as described above, based on the digital signals d0-d3 of plural bits (i.e., output signals d10*-d13* from the data latch section 10), each module current is selected to integrate. Thereby, as shown in FIG. 4, the drive currents ID, which have current values of $2^n$ steps, are generated, thus, any one of drive currents from the two types of drive currents, of which current characteristics are different from each other relative to the gradations (specified gradations), which are specified based on digital signals d0-d3 of plural bits, is generated in accordance with the control signals CNT. Here, in FIG. 4, SPa indicates current characteristic when reference current transistor TP11*a* is selected; and SPb indicates the current characteristic when the reference current transistor TP11*b* is selected. Owing to this, as shown in FIG. 2A and FIG. 3, when the digital signals d0-d3 of four bits are applied, corresponding to the "ON" state of the switching transistors TP16-TP19, which are connected to each of the module current transistors TP12-TP15, drive currents ID, which have 24=16 steps (gradations) of different current values are generated for each current characteristic.

That is, in the current generation circuit 20A, which has the configuration as described above, corresponding to the signal level of the output signals d10*-d13*, which are output from the latch circuits LC0-LC3 in the data latch section 10, the specified switching transistors in the current selection circuit 22A performs an "ON" operation (in addition to the case that any one of the switching transistors TP16-TP19 performs an "ON" operation, the case that all of the switching transistors TP16-TP19 perform and "OFF" operation is also included). To the module current transistors (a combination of two or more of TP12-TP15) in the module current generation circuit 23A, which are connected to the "ON" operated switching transistors, module currents Isa-Isd, which have current values of predetermined ratios ($a\times2^n$; "a" is a constant defined by the channel width W11 of the reference current transistor TP11*a* or TP11*b*) relative to the reference current Iref, which flows through the reference current transistor TP11*a* or TP11*b*. As described above, in the current output terminal OUTi, the drive currents ID, which have current value as a composite value of the module currents, flows from the high potential power supply +V in the direction of the loads via the module current transistors (any of TP12-TP15), which are connected to the switching transistors (any of TP16-TP19) and current output terminal OUTi.

Owing to this, in the current generation supply circuit ILA related to this embodiment, at a timing prescribed by the timing control signals CLK and CLK*, the drive currents ID comprised of analog currents, which have predetermined current values, are generated by the current selection circuit 22A and supplied to the loads corresponding to the digital signals d0-d3 of plural bits, which are input to the data latch section 10 (in this embodiment, as described above, the drive currents are flowed from the current generation supply circuit toward the direction of the loads).

Accordingly, the current generation supply circuit ILA, which has the configuration as described above, for example, based on the control signals CNT (switching control signals CNa and CNb) for switching and controlling the current characteristic, which are output from an external control section (controller) and the like, the switch SAa or SAb is selectively set to the continuity condition. Thus, to either one of the reference current transistor of the reference current transistors TP11*a* or TP11*b* in two formations, the reference current Iref, which has aconstant current value, is supplied (drawn) from the constant current generation source IR via the current input contact INi.

Owing to this, based on reference current Iref and channel width, predetermined voltage levels are generated on the gate terminal (contact Nga) of the reference current transistor, and applied in common to the gate terminals of the module current transistors. Owing to this, the ratio of module currents Isa-Isd, which flows through each of the module current transistors TP12-TP15, is prescribed relative to the reference current Iref, thus, the current characteristic of the drive currents ID is set up.

Owing to this, for example, using a relatively small drive currents, when making loads operate with relatively low luminosity gradations, as shown with the current characteristic SPa in FIG. 4, using the control signals CNT, the reference current Iref is set so as to flow toward the reference current transistor TP11*a* side so that the change of the drive currents is relatively small relative to the specified gradations. Also, using a relatively large drive currents, when making a relatively large loads operate with a relatively high luminosity gradations, as shown with the current characteristic SPb in FIG. 4, using the control signal CNT, reference current Iref is set so as to flow to the reference current transistor TP11*b* so that the change drive currents becomes relatively large relative to the specified gradations. Thereby, in the state that the current value of the reference current, which is supplied to the current generation supply circuit ILA, is held to a constant level, it is possible to make the loads operate with different drive characteristics.

In this embodiment, a current application method, in which current polarity is set so that the drive currents ID flows from the current generation supply circuit relative to the loads, which are connected to the current generation supply circuit, is employed. However, the configuration is not limited to the above. Same as the configurations demonstrated in FIG. 1A and FIG. 1B above, a current sink method, in which the current polarity is set so that the drive currents ID are drawn from the loads side toward the current generation supply circuit maybe employed. Next, an embodiment of the current generation supply circuit corresponding to the current sink method will be described.

<The Second Embodiment of Current Generation Supply Circuit>

Figure 5:
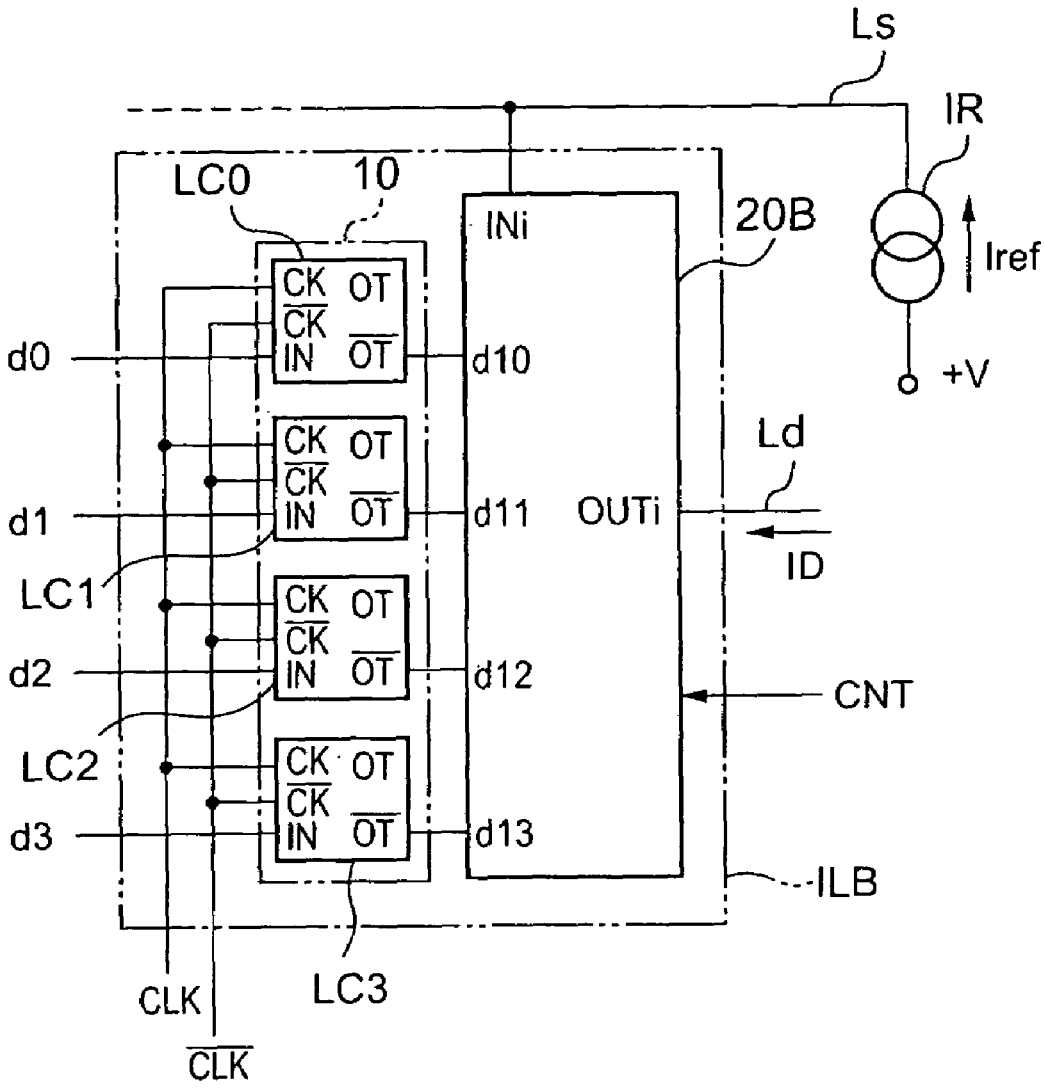
FIG. 5 is a configuration diagram showing the second embodiment of the current generation supply circuit related to the present invention.

FIG. 5 is a configuration diagram showing the second embodiment of the current generation supply circuit related to the present invention.

Figure 6:
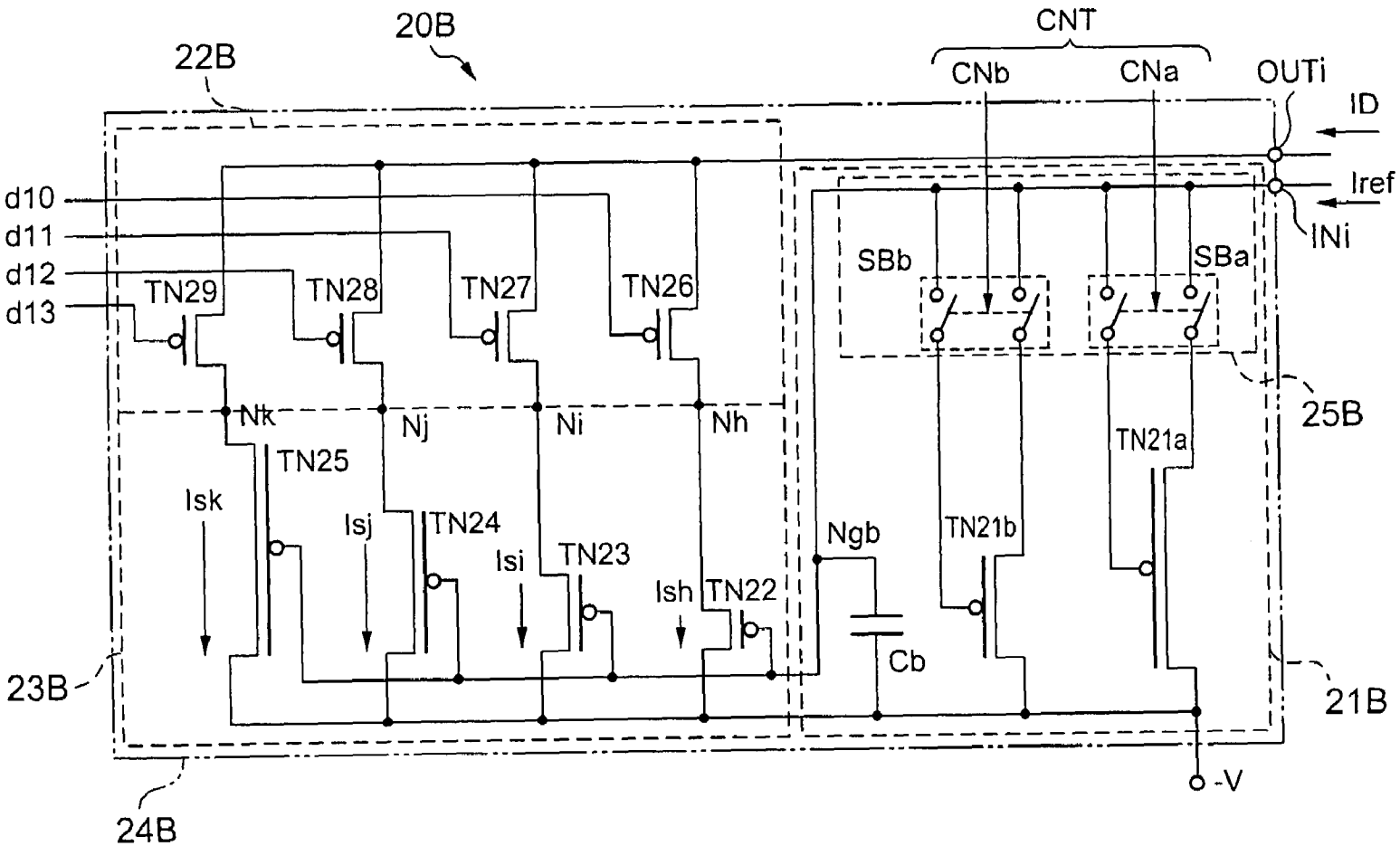
FIG. 6 is a circuit configuration diagram showing an illustrative example of the current generation circuit in the current generation supply circuit related to the present embodiment.

FIG. 6 is a circuit configuration diagram showing an illustrative example of the current generation circuit in the current generation supply circuit related to the present embodiment.

Here, as for the configuration, which is equivalent to that of the above-described embodiments, the same or equivalent reference numerals and symbols will be given thereto and the description therefore will be simplified or omitted.

As shown in FIG. 5, the current generation supply circuit ILB related to this embodiment comprises, same as the above-described first embodiment (FIG. 2 refer to), the data latch section 10 (latch circuit LC0-LC3) which take in the digital signals of a plurality of bits and hold them, and a current generation circuit 20B which takes in the reference current Iref, which is supplied from the constant current generation source IR via the reference current supply line Ls, and is connected to the non-inverted output terminals OT of the data latch section 10, and generates the drive currents ID, which have current values of predetermined ratios relative to the reference current Iref to output (draw) the same to the loads via the drive current supply line Ld. In this embodiment, the constant current generation source IR, which is connected to the current generation circuit 20B, is connected to a high potential power supply +V at the other end to allow the reference current Iref to flow to the current generation circuit 20B.

As shown in FIG. 6, the current generation circuit 20B related to this embodiment has a circuit having, in general, a configuration substantially equivalent to that of the above-described embodiment (refer to FIG. 3). The current generation circuit 20B comprises a reference voltage generation circuit 21B, a characteristic control circuit 25A, a module current generation circuit 23B, and a current selection circuit 22B; based on output signals (non-inverted output signals) d10-d13 from each of the latch circuits LC0-LC3 in the data latch section 10 and control signals CNT (switching control signal CNa and CNb), which are output from the control section; using a module current generation circuit 23B, generates a plurality of module currents Ish, Isi, Isj and Isk (Ish-Isk), which have current values of predetermined ratios relative to the reference current Iref; using the current selection circuit 22B, the module currents are selectively integrated to generate a drive currents ID to supply to the loads. The module current generation circuit 23B and the current selection circuit 22B constitute a drive current generation circuit 24B.

The reference voltage generation circuit 21B comprises the following circuits. That is, a circuit comprises, between a current input contact INi (contact Ngb), which is supplied with the reference current Iref from the constant current generation source IR via reference current supply line Ls, and a low potential power supply −V (for example, grounding potential), a reference current transistors TN21*a*, which is comprised of an n-channel type transistor, and a switch SBa; and a circuit, which includes a reference current transistor TN21*b* comprised of a n-channel type transistor and a switch SBb, which are connected in parallel to each other. Between a contact Ngb, to which the current input contact INi is connected, and a low potential power supply −V, a capacitor (charge storage circuit) Cb is connected to generate a predetermined voltage (reference voltage) corresponding to the reference current Iref on the contact Ngb. It is arranged so that the reference current Iref corresponding to the control signal CNT is supplied to either one of the n-channel type transistors Tn21A or Tn21B. The switches SBa and SBb constitute a characteristic control circuit 25B.

The module current generation circuit 23B has a configuration comprising module current transistors TN22-TN25, which are comprised of an n-channel type transistor having a predetermined channel width respectively, and between each of the contacts Nh, Ni, Nj and Nk and the low potential power supply, −V current paths are connected in parallel, and each control terminal is connected in common with the contact Ngb.

The current selection circuit 22B has a configuration comprised of switching transistors (selection switches) TN26-TN29, in which, between the a current output terminal OUTi, to which the loads are connected, and the above-mentioned contacts Nh, Ni, Nj and Nk, a current path is connected; and, to the control terminal thereof, output signals (non-inverted output signals) d10-d13, which are output from each of the latch circuits LC0-LC3 in the data latch section 10, are applied in parallel.

Here, the transistor size of each of the module current transistors TN22-TN25, which constitute the module current generation circuit 23B (for example, when assuming that the channel length is constant, channel width), arranged, so as to be a predetermined ratio relative to the basis of the reference current transistors TN21A or TN21B, and so that the module currents Ish-Isk, which flow through each current path, respectively have a predetermined ratio of the current value different from each other relative to the reference current Iref.

Here, in the current generation circuit 20B also related to this embodiment, by the switches SAa and SAb in the characteristic control circuit 25A, reference current transistor TN21A or TN21B, which constitute the reference voltage generation circuit 21B, are selectively switched over corresponding to the control signal CNT. Thereby, two kinds of current value of the module currents Ish-Isk, which are generatedby the module current transistors TN22-TN25, can be set.

Using these module currents Ish-Isk, based on the digital signals d0-d3 (i.e., output signals d10-d13 from the data latch section 10), each module current is selected and integrated. Thereby, corresponding to the control signal CNT, two kinds of drive currents ID, which has a current characteristic different from each other relative to the gradations (specified gradations) specified based on the digital signals d0-d3 are generated, and supplied to the loads (in this embodiment, drive current flows in the direction of the current generation supply circuit from the loads).

Accordingly, in the current generation supply circuits ILA and ILB demonstrated in the above first and second embodiment, the reference current Iref having a constant current value is supplied to the current generation circuits 20A and 20B, to which the loads are directly connected via the drive current supply line Ld, from the constant current generation source IR via the reference current supply line Ls, and based on the digital signals d0-d3 of plural bits (output signals d10-d13, or d10*-d13* of the data latch section 10), the drive currents ID having current values capable of making the loads operate at a desired drive state can be generated. Owing to the configuration as described above, the reference current, which is supplied in connection with the generation of the drive currents, is maintained at a constant current level. Even when the current value of the drive currents ID is extremely small, or, even when the period of time for supplying the drive currents ID to the loads (or, drive time of the loads) is set to a short period, the influence of signal delay due to the charge-discharge operation of the parasitic capacitance in the wiring capacitance or the like can be eliminated. And thus, reduction of operation speed of the current generation supply circuit can be reduced. As a result, the loads can be made to operate under swift and appropriate driving conditions.

Also, as the current, which is supplied to the current generation supply circuit to set the current value of the drive currents ID, the reference current Iref having a constant current value is supplied, and the signal level of the digital signals of plural bits is applied as it is. Accordingly, it is possible to integrate plural module currents selectively to generate the drive currents ID. Drive control (generation and supply operation of the drive currents) for making the loads perform gradation driving can be readily carried out.

Further, either one of the two kinds of reference current transistors can be selected using the control signal CNT to flow the reference current Iref. Accordingly, in the state that the current value of the reference current is held to a constant level, the loads can be made to operate with different drive characteristics relative to the specified gradations.

In the above-described first and second embodiments, as the digital signals of plural bits, for example, display data (display signals) for displaying desired image information on the display device may be applied. In this case, the drive currents, which are generated and output by the current generation supply circuit, corresponds to the gradation currents, which is supplied to make each display pixel constituting the display panel to perform the light generation operation with a predetermined luminosity gradations. Hereinafter, a display device in which a current generation circuit having the configuration and function as described above is applied to the data driver will be described concretely.

<The First Embodiment of the Display Device>

Figure 7:
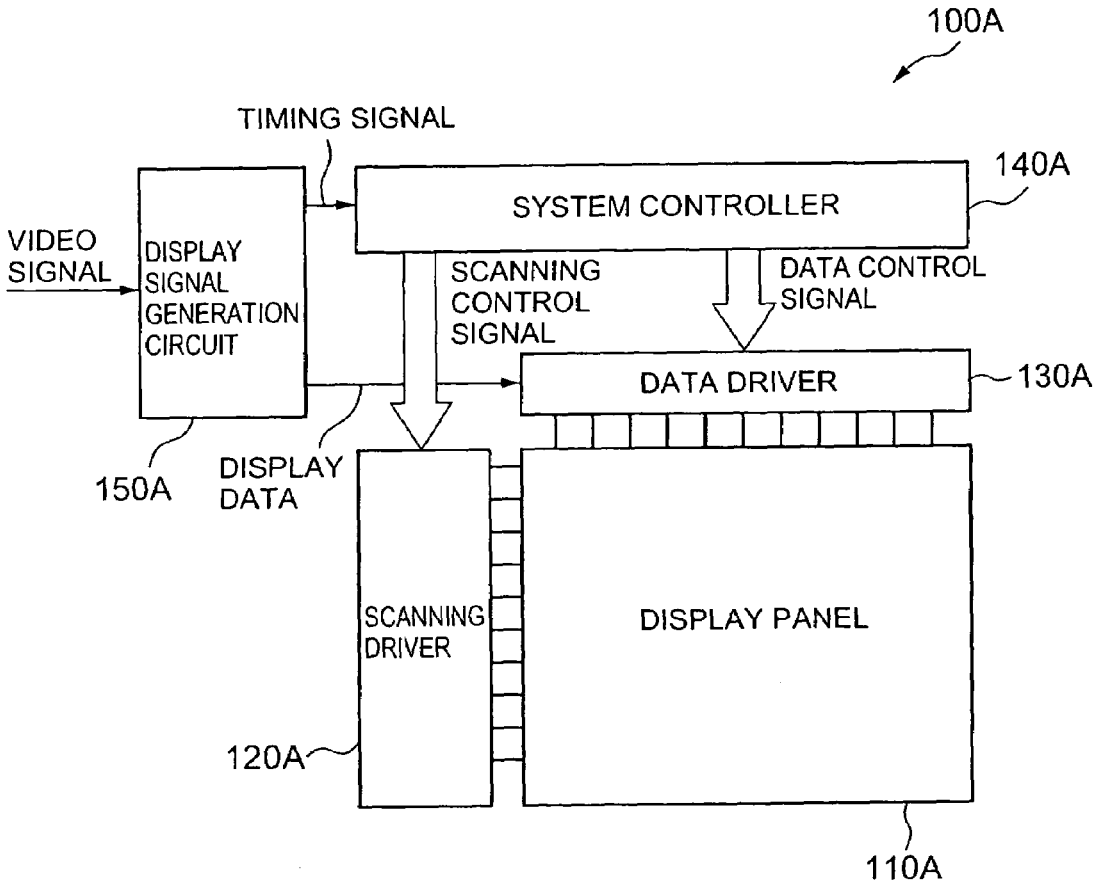
FIG. 7 is a block diagram showing the first embodiment of the display device applicable to the current generation supply circuit related to the present invention.

FIG. 7 is a block diagram showing the first embodiment of the display device applicable to the current generation supply circuit related to the present invention.

Figure 8:
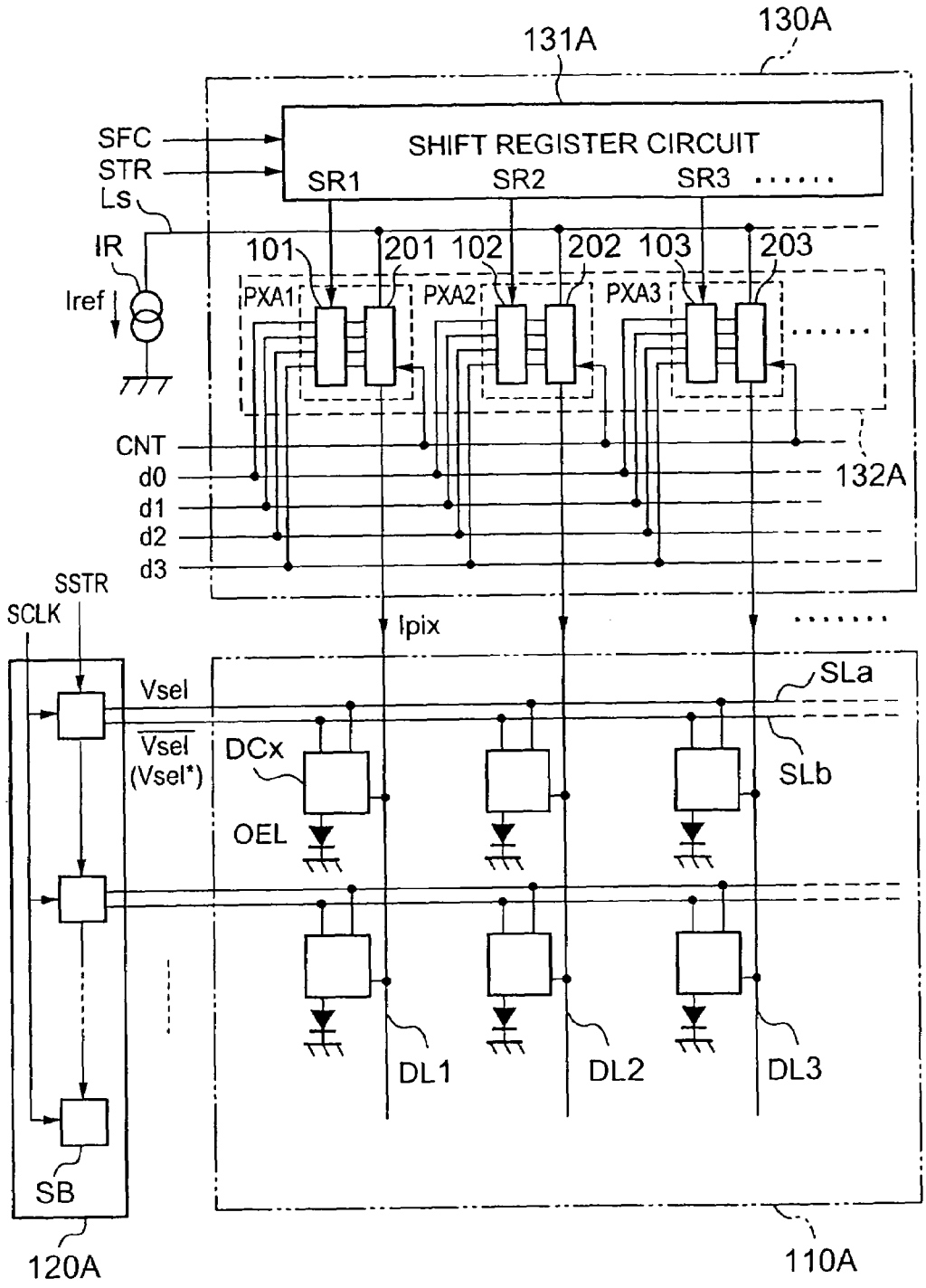
FIG. 8 is a configuration diagram showing the configuration of the principal parts of the display device related to the embodiment.

FIG. 8 is a configuration diagram showing the configuration of the principal parts of the display device related to the embodiment.

Here, as a display panel, a configuration, which has display pixels corresponding to the active matrix system, will be described. In this embodiment, a case in which the current application method to flow gradation currents (drive currents) to display pixels from a data driver side will be described, and the current generation supply circuit described in the above embodiments (FIG. 2A and FIG. 3) will be appropriately referred to.

As shown in FIG. 7 and FIG. 8, a display device 100A related to the embodiment comprises a display panel 110A, in which a plurality of display pixels (loads) are disposed in a matrix shape, a scanning driver (scanning driver circuit) 120A connected to the scanning lines (scan lines) SLa and SLb, which are connected in common with each of the display pixels disposed in the direction of column lines of the display panel 110A, a data driver (signal driver circuit) 130A connected to data lines (signal lines) DL1, DL2, . . . (DL), which are connect in common with each of the display pixels disposed in the direction of row lines of the display panel 110A, a system controller 140A, which generates and outputs various kinds of control signals for controlling the operation condition of the scanning driver 120A and data driver 130A, and a display signal generation circuit 150A, which generates display data, timing signals and the like based on the image signals supplied from the external of the display device 100A.

Hereinafter, the configuration of each section will be described.

(Display Panel)

As shown in FIG. 8, the display panel 110A comprises a plurality of scanning lines including a pair of scanning lines group SLa and SLb disposed in parallel corresponding to the display pixel group in each column, a plurality of data lines DL (DL1, DL2, DL3, □), which correspond to display pixel group in each row lines and arranged perpendicularly relative to each of the scanning lines SLa and SLb, and a plurality of display pixels including a pixel driver circuits DCx and an organic EL devices OEL disposed in the vicinity of each intersection point of the scanning lines and data lines crossing at right angles to each other.

The display pixel comprises, the pixel driver circuits DCx which controls the writing operation and the light generation operation of the gradation currents Ipix in each display pixel based on, for example, a scanning signal Vsel, which is applied thereto from scanning driver 120A via the scanning line SLa, a scanning signal Vsel* (polarity inverted signals of the scanning signal Vsel applied to the scanning lines SLa; refer to a symbol in FIG. 8), which is applied thereto via the scanning line SLb and a gradation currents Ipix (drive currents), which is supplied thereto from the data driver 130A via the data lines DL, and a current control type light emitting devices (for example, organic EL devices OEL) of which light generation luminosity is controlled corresponding to the current value of the light generation drive currents supplied from the pixel driver circuits DCx.

In this embodiment, as the current control type light emitting devices as the display pixels, a configuration, to which an organic EL OEL is applied, is shown. However, the present invention is not limited to the above. Only if the light emitting devices are current control type light emitting devices which perform the light generation operation at predetermined luminosity gradations corresponding to the current values of the light generation drive currents supplied to light emitting devices, other light emitting devices such as light emitting diode also may be applied.

Here, in general, the pixel driver circuits DCx has the following functions; i.e., the pixel driver circuits DCx controls the selection/non-selection state of each display pixel based on the scanning signal Vsel or Vsel*; and in the selection state, takes in the gradation currents Ipix corresponding to the display data and holds as the voltage level; and in the non-selection state, supplies light generation drive currents based on the above-mentioned held voltage levels to the organic LE devices OEL to maintain the light generation operation at predetermined luminosity gradations. An example of the concrete circuit configuration applicable to the pixel driver circuits DCx will be described later.

(The Scanning Driver)

As shown in FIG. 8, the scanning driver 120A comprises a plurality of steps of shift blocks SB, which is composed of a shift resister and a buffer respectively, corresponding to the scanning lines SLa and SLb in each column. Based on scanning control signals (scanning start signal SSTR, scanning clock signal SCLK and the like) supplied from the system controller 140A, shift signals, which are shifted from the top to bottom of the display panel 110A and output by the shift resister, are applied to each of the scanning lines SLa via the buffer as scanning signals Vsel having a predetermined voltage level (selection level; for example, high-level), and a voltage level of the scanning signals Vsel, of which polarity is inverted, is applied to each scanning line SLb as scanning signal Vsel*. Owing to this, it is controlled so that the display pixels of each column are set to selection state, and gradation currents Ipix based on the display data to be supplied is written on each display pixel from the data driver 130A via each data lines DL.

(Data Driver)

As shown in FIG. 8, based on data control signals (shift start signal STR and shift clock signal SFC and the like, which will be describe later), which are supplied from the system controller 140A, the data driver 130A controls so as to take in and hold the display data which are comprised of digital signals of a plurality of bits supplied from the display signal generation circuit 150A, to generate the gradation currents Ipix having a current value corresponding to the display data, and to supply the display data in parallel to each of the display pixels, which are set to the selection state by the scanning driver 120A via each of the data lines DL. Concrete circuit configuration and the drive control operation of the data driver 130A will be described later in detail.

(System Controller)

Based on the timing signals supplied from the display signal generation circuit 150A, the system controller 140A generates and outputs, at least, the scanning control signals (above-described scanning start signal SSTR and scanning clock signal SCLK and the like) and the data control signal (above-described shift start signal STR and shift clock signal SFC and the like) to the scanning driver 120A and the data driver 130A; thereby controls to operate each driver at predetermined timing to make the display panel 110A output scanning signals Vsel and Vsel* and gradation currents Ipix to continuously execute a predetermined control operation in the pixel driver circuits DCx (described later in detail); thus, a predetermined image information based on the image signals is displayed on the display panel 110A.

(Display Signal Generation Circuit)

The display signal generation circuit 150A extracts, for example, the luminosity gradation signal component from the image signals supplied from the external of the display device 100A, and supplies the luminosity gradation signal component, per column of the display panel 110A, to the data driver 130A as the display data comprised of a plurality of bit digital signals. Here, in the case where the above-mentioned image signals include timing signal components, which prescribes the display timing of the image information like TV broadcasting signals, (composite image signals), in addition to the function to extract the above luminosity gradation signal component, the display signal generation circuit 150A may have a function to extract the timing signal components and supply the same to the system controller 140A. In this case, the system controller 140A generates the above-mentioned scanning control signal and data control signal to be supplied to the scanning driver 120A and the data driver 130A based on the timing signals, which are supplied from the display signal generation circuit 150A.

In this embodiment, as for the mounting configuration between the display panel 110A and peripheral circuits such as the driver and the controller, it is not limited particularly. For example, the display panel 110A, the scanning driver 120A and the data driver 130A may be formed on a single substrate. Or, only the data driver 130A, or the scanning driver 120A and the data driver 130A may be formed on a single substrate as, for example, IC chip separately from the display panel 110A, and connected electrically to the display panel 110A.

(The First Embodiment of the Data Driver)

First embodiment mode, which comprises a data driver and a display device related to this embodiment, will be described.

The first embodiment of the data driver related to this embodiment is, generally, configured as described below. That is, a plurality of gradation current generation supply circuits, which has a configuration equivalent to the current generation supply circuit ILA (the data latch section 10 and the current generation circuit 20A) shown in FIG. 2, is provided corresponding to each of a plurality of data lines DL. And, to each of the gradation current generation supply circuits, for example, a reference current Iref having a constant current value is supplied (in this embodiment, reference current Iref is supplied so as to be drawn) from a single constant current generation source (constant current source) IR via a common reference current supply line.

To be more precise, the data driver 130A related to this embodiment comprises the following circuits. That is, for example, as shown in FIG. 8, a shift register circuit 131A, which sequentially outputs shift signals SR1, SR2, SR3, . . . (equivalent to the above-described timing control signal CLK) at predetermined timing while shifting the shift start signal STR based on shift clock signal SFC, which is supplied as the data control signal from the system controller 140A; a gradation current generation supply circuit group 132A comprised of gradation current generation supply circuits PXA1, PXA2, PXA3, . . . (equivalent to the above-described current generation supply circuit ILA; hereinafter, for convenience, also referred to as "gradation current generation supply circuit PXA"), which, based on the output timing shift signals SR1, SR2, SR3, . . . from the shift register circuit 131A, sequentially takes in the display data d0-dq (here, for convenience, it is assumed as q=3 corresponding to digital signals d0-d3, which are input by the current generation supply circuit ILA shown in FIG. 2A and FIG. 3) for one column, which are supplied sequentially from the display signal generation circuit 150A, generates gradation currents Ipix (drive currents) corresponding to the light generation luminosity in each display pixels, and supplies the same to the data lines (equivalent to the above-mentioned drive current supply line Ld) DL1, DL2, . . . ; and a constant current generation source IR provided outside the data driver 130A, which constantly supplies the reference current Iref having a constant current value to each of the gradation current generation supply circuits PXA1, PXA2, PXA3, . . . via a common reference current supply line Ls.

Here, each of the gradation current generation supply circuits PXA1, PXA2, PXA3, . . . comprises data latch sections (signal holding circuits) 101, 102, 103, . . . , equivalent to the current generation supply circuit ILA (FIG. 2 and FIG. 3) and, current generation circuits 201, 202, 203, . . . , respectively; and are arranged so as to switch to control the plurality of reference current transistors (refer to FIG. 3) in the reference voltage generation circuits formed in each of the current generation circuits 201, 202, 203, . . . based on the control signals CNT (switching control signal CNa and CNb) supplied as the data control signal from the system controller 140A, thereby to alter and set the current characteristic of the gradation currents Ipix relative to the specified gradations based on the display data d0-d3.

In this embodiment, a configuration such that the reference current Iref is supplied from a single constant current generation source IR in common to every gradation current generation supply circuits PXA1, PXA2, PXA3, . . . , which are formed in the data driver 130A, is demonstrated. However, the present invention is not limited to the above. For example, in the case where a plurality of data drivers is provided to the display panel, a constant current generation source may be provided respectively corresponding to data driver, and further, each of the plurality of gradation current generation supply circuits formed in a single data driver may comprise the constant current generation source.

(Configuration of the Display Pixels)

Here, an example of the configuration of the pixel driver circuits, which is applicable to each display pixel on the display panel in the display device of this embodiment, will be described briefly.

Figure 9:
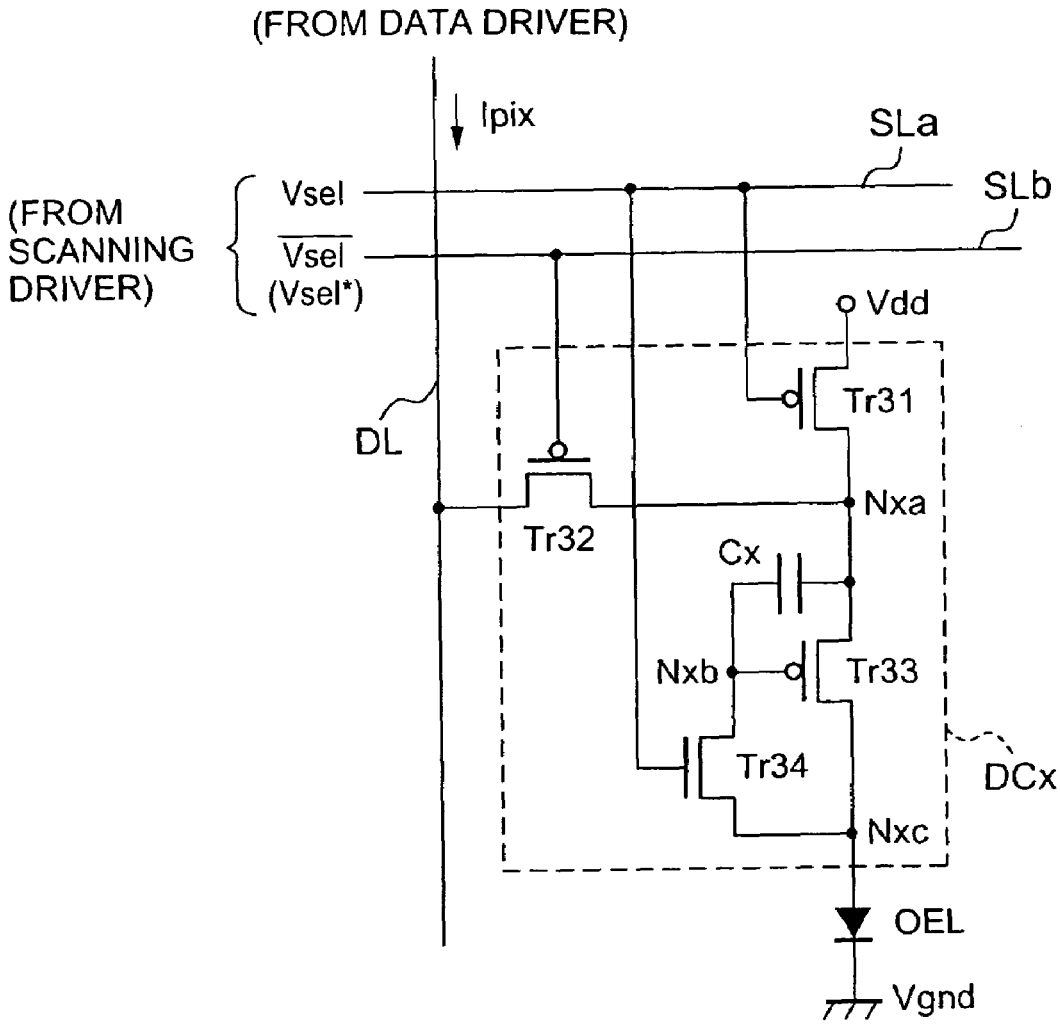
FIG. 9 is a circuit configuration diagram showing one composition example of the configuration of a display pixel (pixel driver circuits) applied to the embodiments.

FIG. 9 is a circuit configuration diagram showing one composition example of the configuration of a display pixels (pixel driver circuits) applied to the embodiments.

The pixel driver circuits described here are just for demonstrating an example, which are applicable to the display device employing the current application method; it is needless to say that another circuit configuration, which has a function equivalent thereto, may be employed.

As shown in FIG. 9, the pixel driver circuits DCx related to the example of this configuration comprises a p-channel type transistor Tr31, in the vicinity of intersection point of the scanning line SLa, SLb and the data lines DL, the gate terminal is connected to the scanning line SLa; and the source terminal and the drain terminal are connected to a power supply contact Vdd and a contact Nxa respectively; a p-channel type transistor Tr32 of which gate terminal is connected to the scanning line SLb, and the source terminal and the drain terminal are connected to the data lines DL and the contact Nxa respectively; a p-channel type transistor Tr33 of which gate terminal is connected to a contact Nxb, the source terminal and the drain terminal are connected to a contact Nxa and a contact Nxc respectively; an n-channel type transistor Tr34 of which gate terminal is connected to the scanning line SL, the source terminal and the drain terminal are connected to a contact Nxb and a contact Nxc respectively; and a capacitor (holding capacitance) Cx connected between the contact Nxa and the contact Nxb. Here, the power supply contact Vdd is, for example, connected to the high potential power supply via a power supply line, and, constantly or at predetermined timing, applied with a constant high potential voltage.

Also, the organic EL devices OEL of which light generation luminosity is controlled by the light generation drive currents supplied from the pixel driver circuits DCx as described above has a configuration such that anode terminal is connected to the contact Nxc of the above-mentioned pixel driver circuits DCx, and the cathode terminal is connected to a low potential power supply (for example, grounding potential Vgnd). Here, the capacitor Cx may be a parasitic capacitance generated between the gate-source of the transistor Tr33; and in addition to the parasitic capacitance, between the gate-source, a capacitance device may be added.

The drive control operation of the organic EL devices OEL in the pixel driver circuits DCx, which has a configuration as described above, is as described below. First of all, in a writing operation period, for example, a high-level (selection level) scanning signal Vsel is applied to the scanning line SLa, a low-level scanning signal Vsel* is applied to the scanning line SLb. Synchronizing to this timing, the gradation currents Ipix for making the organic EL devices OEL perform the light generation operation at predetermined luminosity gradations are supplied to the data lines DL. Here, as the gradation currents Ipix a positive current are supplied to set so that the current flows toward the direction of the display pixels (pixel driver circuits DCx) so as to be flowed (to apply) from the data driver 130A via the data lines DL. Owing to this, transistors Tr32 and Tr34 constituting the pixel driver circuits DCx performs an "ON" operation, and the transistor Tr31 performs an "OFF" operation, and thus, positive potential corresponding to the gradation currents Ipix supplied to the data lines DL is applied to the contact Nxa. Further, conductivity between the contact Nxb and the contact Nxc is established via the transistor Tr34, the gate-drain of the transistor Tr33 is controlled at the same potential. Owing to this, transistor Tr33 performs an "ON" operation in a saturation area. Between the both ends of the capacitor Cx, (between contact Nxa and the contact Nxb), a difference of potential corresponding to the gradation currents Ipix, electrical charge corresponding to the difference of potential is stored and held (electrical charge) as the voltage component, and light generation drive currents corresponding to the gradation currents Ipix flow to the light emitting devices OEL (organic EL devices) via the transistor Tr33, thus, the light generation operation of the organic EL devices OEL starts.

Next, in the light generation operation period, the scanning signal Vsel of low-level (non-selection level) is applied to the scanning lines SLa, and the high-level scanning signals Vsel* is applied to the scanning lines SLb. Synchronizing to this timing, the supply of the gradation currents Ipix is shut down. Owing to this, the transistors Tr32 and Tr34 perform an "OFF" operation and the electrical continuity between the data lines DL and contact Nxa and the contact Nxb and the contact Nxc is shut down, and accordingly, the capacitor Cx holds electrical charge, which is accumulated in the above-described writing operation.

As described above, since the capacitor Cx holds the voltage charged during writing operation, the difference of potential between the contact Nxa and the contact Nxb (between gate-source of the transistor Tr33) is held, and the transistor Tr33 maintains the "ON" operation. Further, by applying the scanning signal Vsel (low-level), the transistor Tr31 performs "ON" operation. Accordingly, the light generation drive currents corresponding to gradation currents Ipix (more particularly, electrical charge held by the capacitor Cx) flows to the organic EL devices OEL from the power supply contact Vdd (high potential power supply) via the transistor Tr31 and Tr33, thus, the light generation operation of the organic EL devices OEL is maintained at predetermined luminosity gradations. As described above, in the pixel driver circuits DCx related to this embodiment, the transistor Tr33 has a function as a light emitting drive transistor.

<Drive Control Method of the Display Device>

Next, referring to drawings, the data driver of this embodiment and the operation of the display device including the same will be described.

Figure 10:
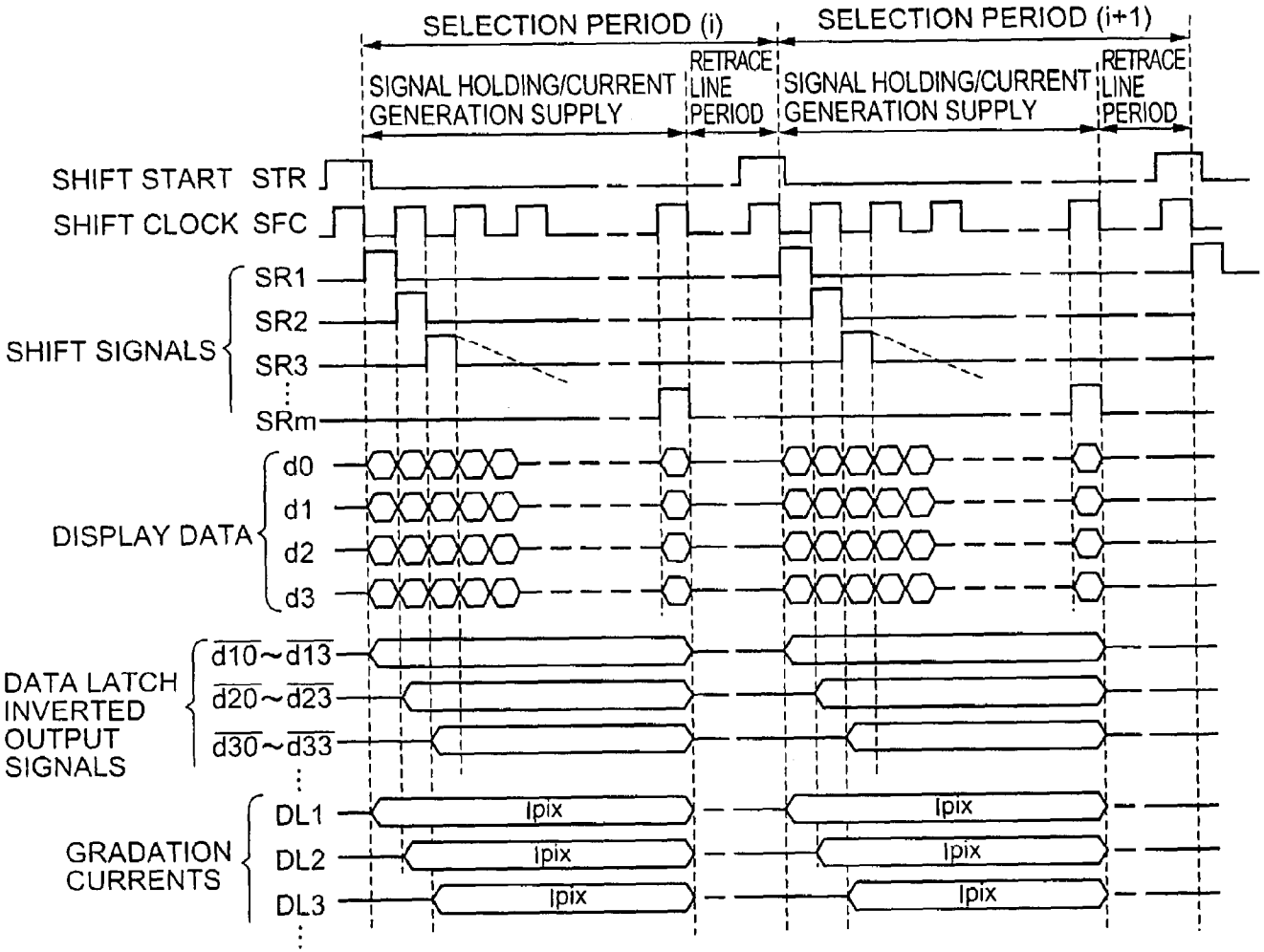
FIG. 10 is a timing chart showing an example of the control operations in the first embodiment of the data driver related to the embodiments.

FIG. 10 is a timing chart showing an example of the control operations in the first embodiment of the data driver related to the embodiments.

Figure 11:
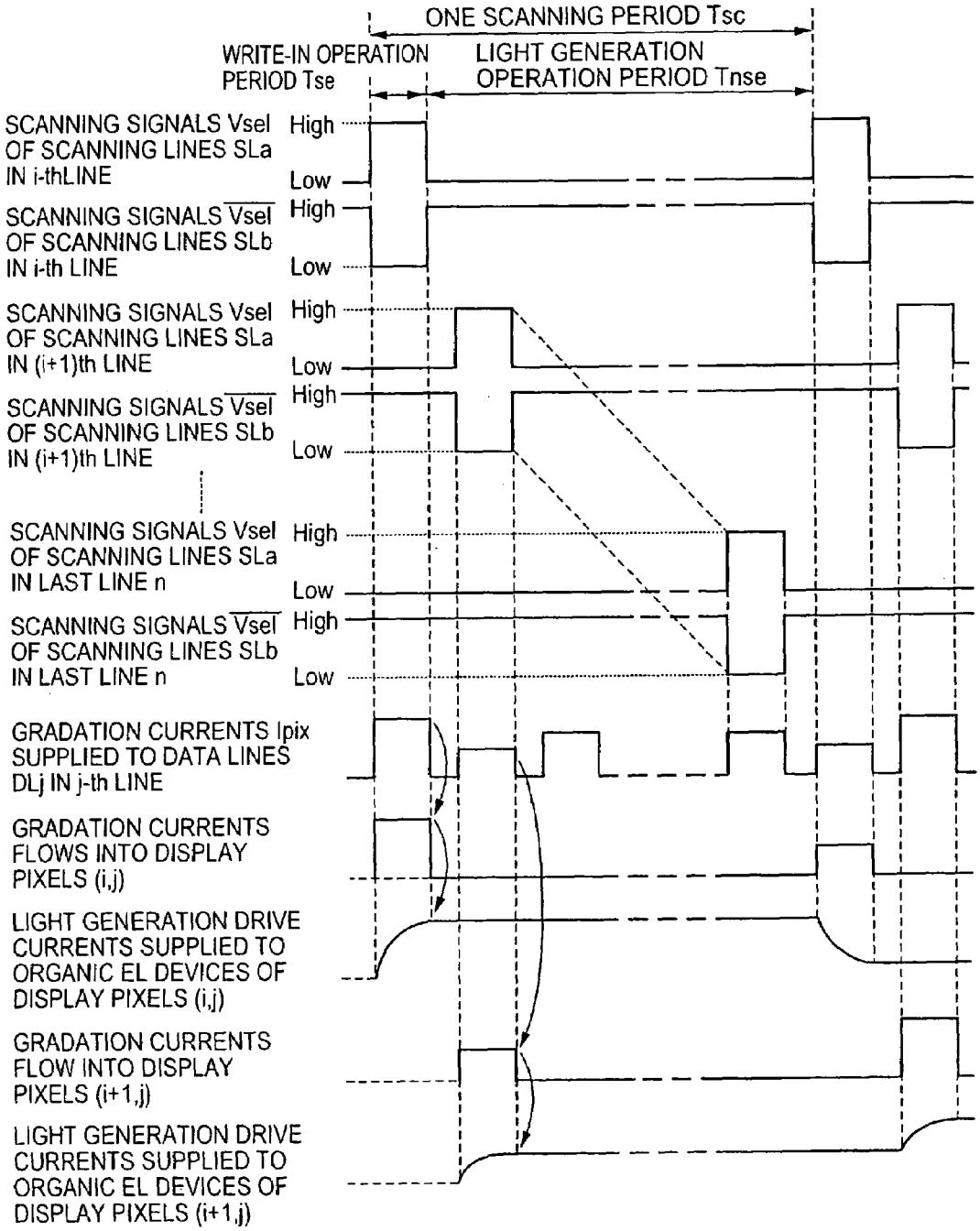
FIG. 11 is a timing chart showing an example of a control operations in the display panel (display pixel) related to the embodiments.

FIG. 11 is a timing chart showing an example of a control operations in the display panel (display pixels) related to the embodiments.

Figure 12:
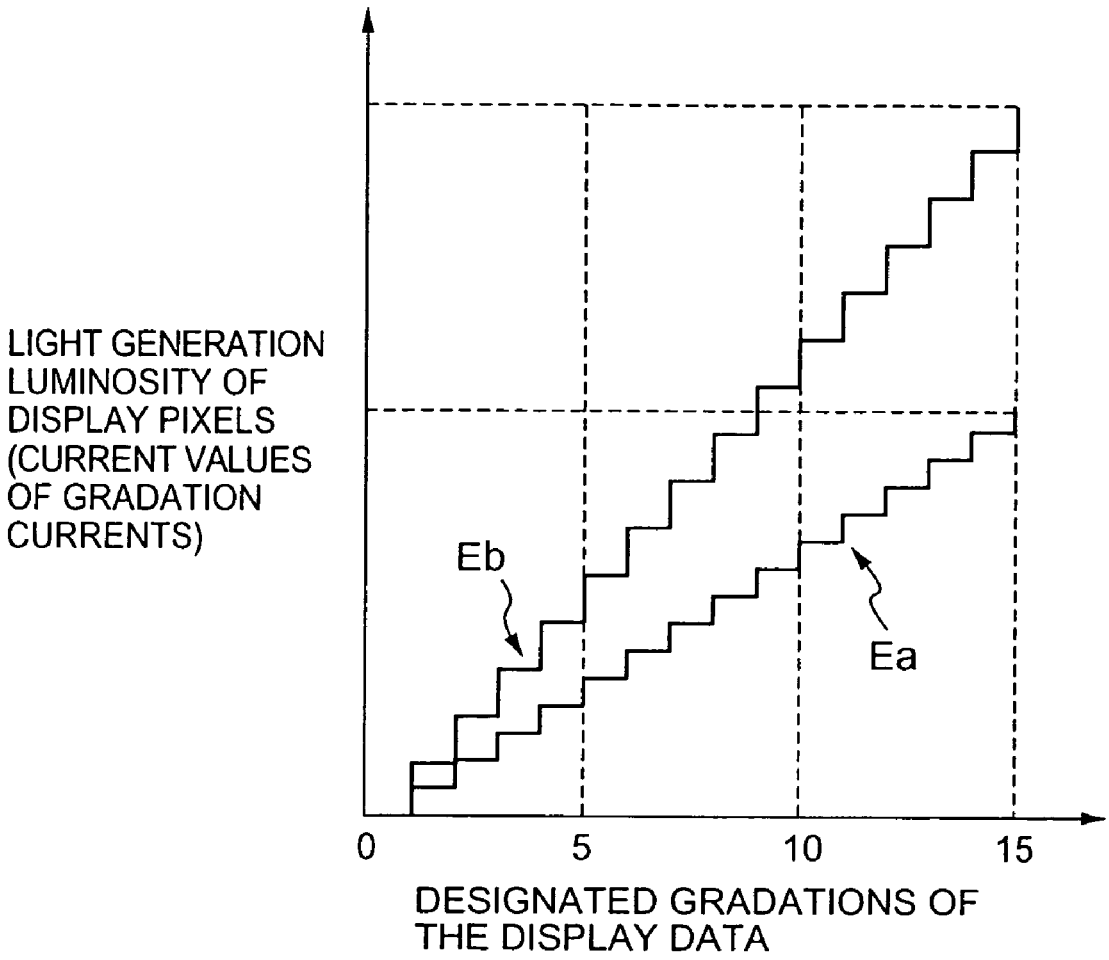
FIG. 12 is a diagram showing an example of the light generation luminosity characteristic of the display pixels relative to specified gradations in the display device related to the embodiments.

FIG. 12 is a diagram showing an example of the light generation luminosity characteristic of the display pixels relative to specified gradations in the display device related to the embodiments.

Here, in addition to the configuration of the data driver shown in FIG. 8, appropriately referring to the configuration of the current generation supply circuit shown in FIG. 2 and FIG. 3, the description will be made.

(The Control Operation of the Data Driver)

The control operation in the data driver 130A is executed by sequentially setting the following operations first; i.e., a signal holding operation in which display data d0-d3, supplied from the display signal generation circuit 150A to the data latch sections 101, 102, 103, . . . provided in each of the gradation current generation supply circuits PXA1, PXA2, PXA3, . . . , are taken in and held, and output signals (inverted output signal) based on the display data d0-d3 are output for a predetermined period; and a current generation supply operation in which gradation currents Ipix corresponding to the above display data d0-d3 are generated by the current generation circuits 201, 202, 203, . . . based on the output signals from the data latch sections 101, 102, 103, . . . and supplied the same independently to each of the display pixels (pixel driver circuits DCx) via each of the data lines DL1, DL2, DL3, . . . .

Here, as shown in FIG. 10, in the signal holding operation, the operation to sequentially take-in the display data d0-d3, which change corresponding to the display pixels (i.e., each of the data lines DL1, DL2, DL3, . . . ) in each row, by each of the above data latch sections 101, 102, 103, . . . based on the shift signals SR1, SR2, SR3, . . . , which are sequentially output from the shift register circuit 131, is executed continuously on the basis of one column, and the state that the output signals, which are output to each of the current generation circuits 201, 202, 203, . . . , in order the data latch sections 101, 102, 103, . . . in which the display data d0-d3 are taken, are held for a predetermined period (for example, a period until the next high-level shift signals SR1, SR2, SR3, . . . are output).

Further, in the current generation supply operation, based on the output signals output from the above data latch sections 101, 102, 103, . . . , the "ON-OFF" state of a plurality of switching transistors (corresponding to the switching transistors TP16-TP19 shown in FIG. 3) in the current selection circuit provided in each of the current generation circuits 201, 202, 203, . . . is controlled. And the composite currents of the module currents, which flow to each module current transistor (corresponding to transistors TP12-TP15 shown in FIG. 3) in module current generation circuit connected to the "ON" operated switching transistor, are generated as the gradation currents Ipix and sequentially supplied to each of the data lines DL1, DL2, DL3 . . . .

Here in the data driver 130A related to this embodiment, as described above, based on the control signal CNTs (switching control signals CNa and CNb) output from the system controller 140, a plurality of reference current transistors (2 components in the case of the current generation supply circuit shown in FIG. 3), which are provided in the reference voltage generation circuits of the current generation circuits 201, 202, 203, . . . in the gradation current generation supply circuit section PXA, are selectively controlled to switchover. Corresponding to the channel width of each of the reference current transistors, a plurality of module current ratios relative to the reference current Iref are set. Accordingly, for example, by setting the control signal CNT prior to the above-mentioned signal holding operation, the gradation currents Ipix having random gradation-current characteristic is generated and supplied.

Here, the gradation currents Ipix are set so as to, for example, be supplied to every data lines DL1, DL2, DL3, . . . in parallel at least for a predetermined period. Also, in this embodiment, as described above, a plurality of module currents having a current value of a predetermined ratio (for example, a×2k; k=0, 1, 2, 3, . . . ), which is previously prescribed based on the transistor size relative to the reference current Iref, are generated, and based on the above-mentioned inverted output signals, the switching transistor performs the "ON-OFF" operation. Thus, predetermined module currents are selected and integrated to generate positive gradation currents Ipix, and the gradation currents Ipix are supplied to flow from the data driver 130A side in the direction flowed into the datalines DL1, DL2, DL3, . . . .

When the data driver 130A related to this embodiment has the configuration shown in FIG. 8, a configuration such that, relative to the common reference current supply line Ls, to which the reference current Iref having a constant current value is supplied from the constant current generation source IR, a plurality of gradation current generation supply circuit PXA1, PXA2, PXA3, . . . are connected in parallel, is given. As shown in FIG. 10, in each of the gradation current generation supply circuits PXA1, PXA2, PXA3, . . . based on the display data d0-d3, the gradation currents Ipix, which are supplied simultaneously to each of the data lines DL1, DL2, DL3, . . . (display pixels) in parallel, are generated. Accordingly, the currents, which are supplied to each of the gradation current generation supply circuits PXA1, PXA2, PXA3, . . . via the reference current supply line Ls is not the reference current Iref itself, which is supplied by the constant current generation source IR, but the currents having current values (Iref/m), which are divided substantially equally each other corresponding to the number of the gradation current generation supply circuits (i.e., equivalent to the number of the data lines disposed in the display panel 110A; for example, m lines), are supplied.

In this case, taking into consideration the above current value (Iref/m), which is supplied to each of the gradation current generation supply circuits PXA1, PXA2, . . . , the ratio of each module current (i.e., the rate of the channel width of the module current transistor relative to the reference current transistor) relative to the reference current Iref, which is set in the current mirror circuit constituting the current generation circuits 201, 202, 203, . . . of each of the gradation current generation supply circuits PXA1, PXA2, PXA3, . . . , may be set to, for example, a rate m-times larger than that in the circuit configuration shown in FIG. 3.

Further, as another configuration, for example, to each of the gradation current generation supply circuits PXA1, PXA2, PXA3, . . . , a switchover circuit, which performs an "ON" operation selectively based on the shift signals SR1, SR2, SR3, . . . output from the shift register circuit 131A, may be provided; and it may be arranged so that, in each current generation circuits 201, 202, 203, . . . , in a period of current generation supply operation when the gradation currents Ipix are generated based on the display data d0-d3, reference current Iref from the above-mentioned constant current generation source IR may be selectively supplied to any one circuit of the gradation current generation supply circuits PXA1, PXA2, PXA3, . . . as it is.

As for the control operation in the display panel 110A (display pixels), as shown in FIG. 11, assuming that one scan period Tsc in which random image information is displayed on a screen of the display panel 110A is 1 cycle, in the one scanning period TsC; a write-in operation period Tse (selection period) in which the display pixels, which are connected to specified scanning lines are selected; gradation currents Ipix corresponding to the display data d0-d3, which are supplied from the data driver 130A, are written and held as the signal voltage and a light generation operation period Tnse (non-selection period of the display pixels), in which, based on the held signal voltage, the light generation drive currents corresponding to the above display data are supplied to the organic EL devices OEL to perform the light generation operation at predetermined luminosity gradations are set (Tsc=Tse+Tnse), and in each operation period, a drive control equivalent to the above-described pixel driver circuits DCx is executed. Here, the write-in operation period Tse, which is set on the basis of each column, is set so as not to allow any overlap of time with each other. Also, the write-in operation period Tse is set to a period in which, in the current generation supply operation in the data driver 130A, at least, a predetermined period for supplying gradation currents Ipix to the data lines DL in parallel is comprised.

That is, in the write-in operation period Tse to the display pixels, as shown in FIG. 11, relative to the display pixels of specified lines (i-th lines), the scanning lines SLa and SLb are scanned by the scanning driver 120A at predetermined signal levels. Thereby an operation, in which gradation currents Ipix supplied to each of the data lines DL in parallel by the data driver 130A is held simultaneously as the voltage component, is executed. After that, in the light generation operation period Tnse, the light generation drive currents based on the voltage component, which is held during the above writing operation period Tse, are supplied continuously to the organic EL devices OEL. Thus, the light generation operation at luminosity gradations corresponding to the display data is continued.

As shown in FIG. 11, a sequence of drive control operation as described above is repeatedly executed in order relative to the display pixels of every line of the display pixel groups constituting the display panel 110A. Thereby, display data for one screen of the display panel is written, and each of the display pixels emits light at predetermined luminosity gradations, thus the desired image information is displayed.

Accordingly, in accordance with the data driver related to this embodiment and the display device including the same, the gradation currents Ipix, which are supplied to the display pixels on a specific column from each of the gradation current generation supply circuits PXA1, PXA2, PXA3, . . . via each of the data lines DL are generated based on constant reference current Iref supplied from a single constant current generation source IR (via the common reference current supply line Ls), of which signal level does not change, and, the display data d0-d3 comprised of digital signals of plural bits. Accordingly, even when the display pixels are made to perform the light generation operation with a relatively low luminosity gradations (the case where the current values of the gradation currents Ipix are extremely low), or even when, accompanying the high miniaturization and precision of the display panel, the supply time (selection time) of the gradation currents Ipix to the display pixels is set to a short period of time, relative to the generation of the gradation currents Ipix, the influence of the transmission delay of the signals, which are supplied to the data drivers (each of the gradation current generation supply circuits PXA1, PXA2, PXA3, . . . ), can be eliminated, and it is possible to prevent the operation speed of the data driver from reducing. Further, the gradation currents, which are generated by each of the gradation current generation supply circuits PXA1, PXA2, PXA3, . . . can be made uniform; thus, the display response characteristic and display quality in the display device can be improved.

Also, in this case, the current characteristic of the gradation currents Ipix, which are independently supplied to each of the data lines DL1, DL2, DL3, . . . from the gradation current generation supply circuits PXA1, PXA2, PXA3, . . . can be arbitrarily controlled based on the control signal CNT. Accordingly, same as the case shown in FIG. 4, for example, as shown in FIG. 12, the light luminosity characteristic (gradation-luminosity characteristic), which represents the changes of the light generation luminosity (i.e., current value of the gradation currents Ipix) in the display pixels (light emitting devices) relative to the gradations, which are specified based on the display data, can be set to in two types (Ea and Eb). Accordingly, the light luminosity characteristic can be readily changed and set only by setting operation of the control signals CNT without controlling to change the reference current Iref and the display data d0-d3.

Accordingly, for example, when an electronic apparatus, which is equipped with display devices related to this embodiment, is used under such conditions as indoors and the like where is relatively poor in ambient luminance, as shown with luminosity characteristic Ea in FIG. 12, gradation luminosity characteristic of the display pixels is set to a characteristic so as to change gradually; and when the electronic apparatus is used under conditions such that the ambient luminance is high like outdoor or the like, as shown with luminosity characteristic Eb in FIG. 12, the gradation-luminosity characteristic of the display pixels changes abruptly. Thereby, it is possible to make the display pixels perform the light generation operation with an appropriate light generation luminosity corresponding to the ambient luminance without changing the display data. Thus, desired image information can be displayed with satisfactory visibility.

In the above-described embodiment, as the data drivers and display pixels (pixel driver circuits), the configuration to which the current application method is applied, is demonstrated. The present invention is not limited to the above. It is needless to say that, a configuration such that current generation supply circuit ILB as shown in FIG. 5 and FIG. 6, may be applied to the gradation current generation supply circuit and a current sink method which supplies gradation currents Ipix from the display pixels in the direction drawn toward the data drivers may be employed.

(The Second Embodiment of the Display Device)

Next, a second embodiment of the data driver (gradation current generation supply circuit) related to this embodiment and a display device provided with the same will be described.

Figure 13:
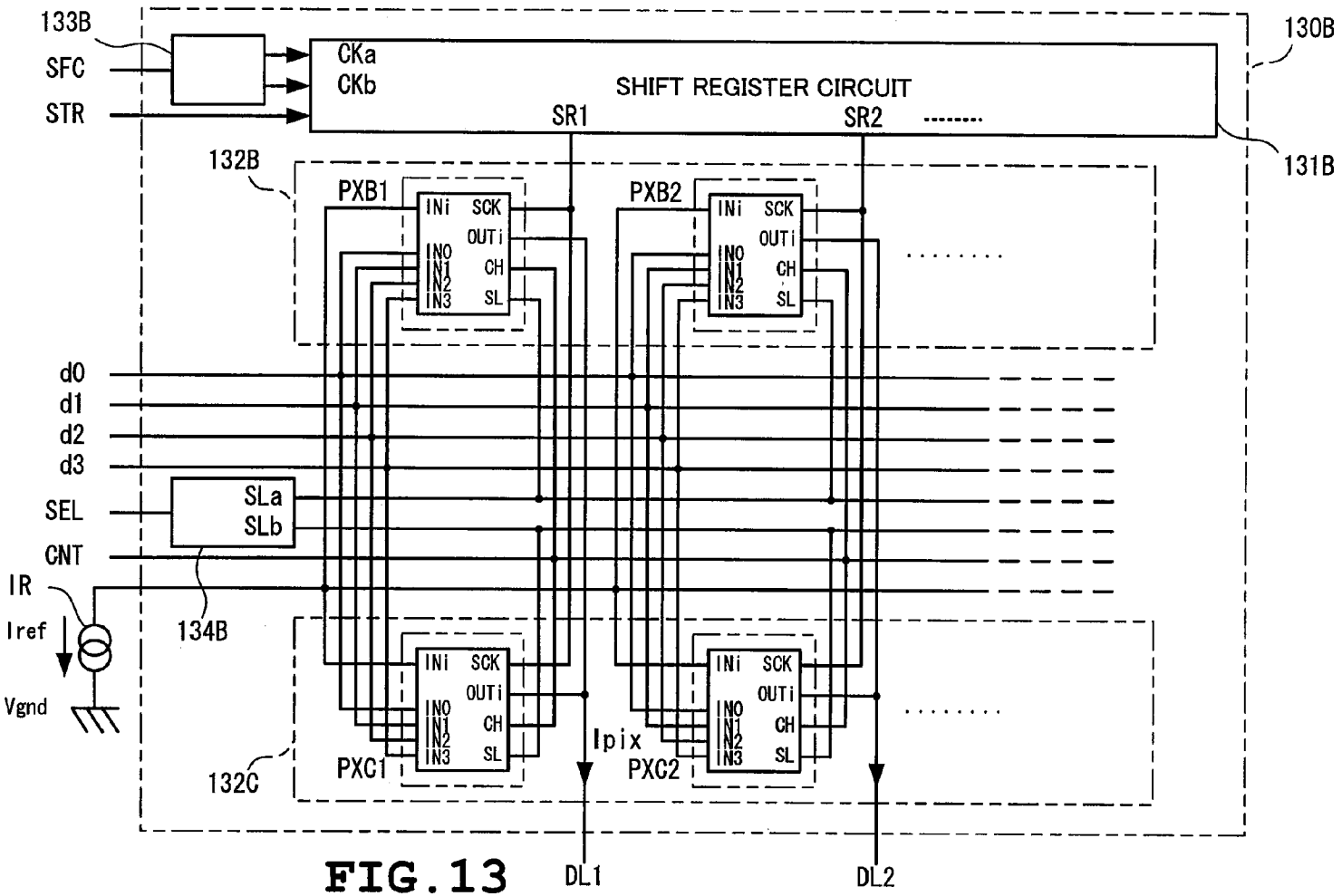
FIG. 13 is a configuration diagram of the principal parts of the second embodiment of the data driver related to the embodiments.

FIG. 13 is a configuration diagram of the principal parts of the second embodiment of the data driver related to the embodiments.

Figure 14:
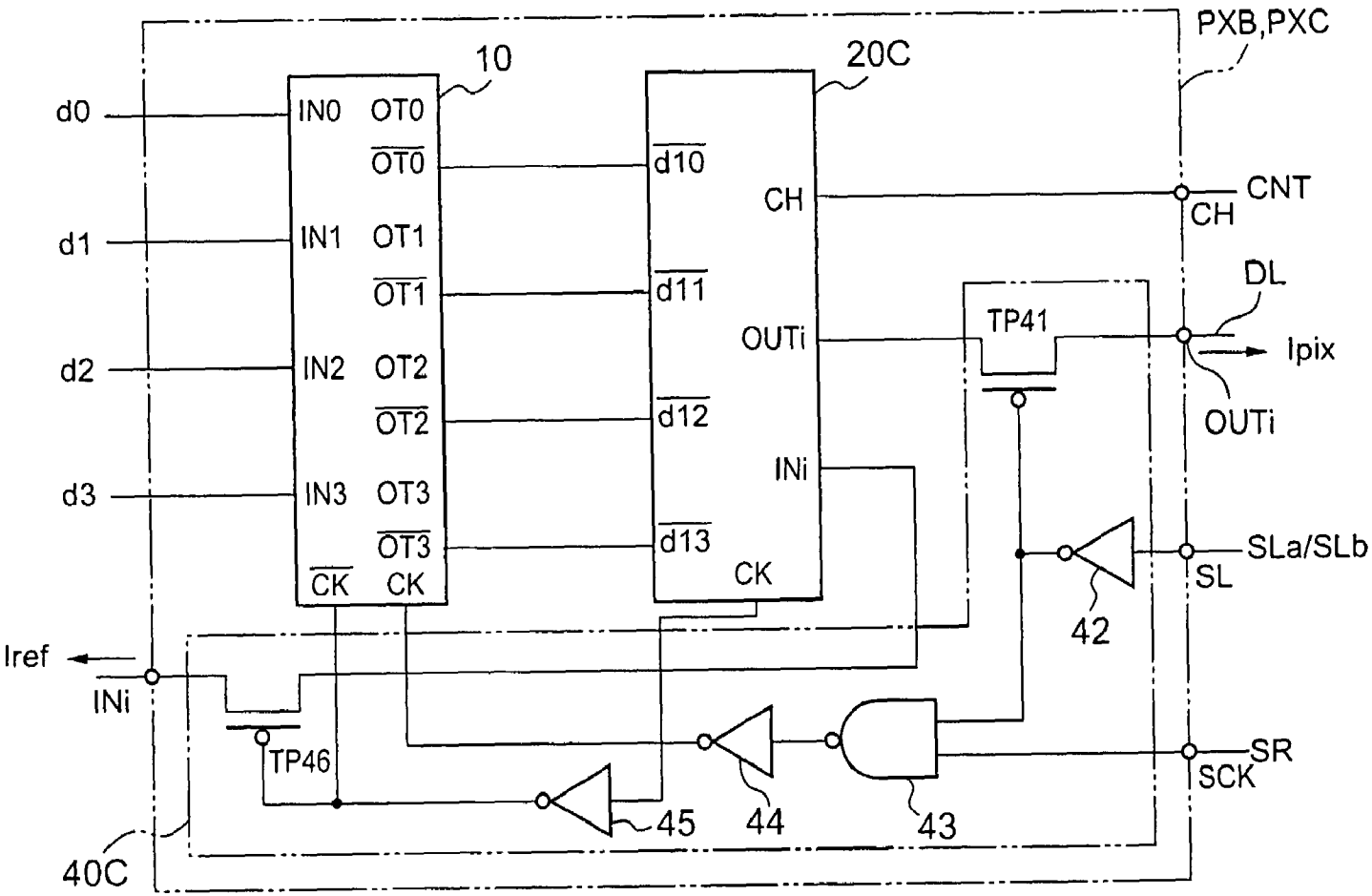
FIG. 14 is a configuration diagram showing an illustrative example of the gradation current generation supply circuit applicable to the second embodiment of the data driver related to the embodiments.

FIG. 14 is a configuration diagram showing an illustrative example of the gradation current generation supply circuit applicable to the second embodiment of the data driver related to the embodiments.

Figure 15:
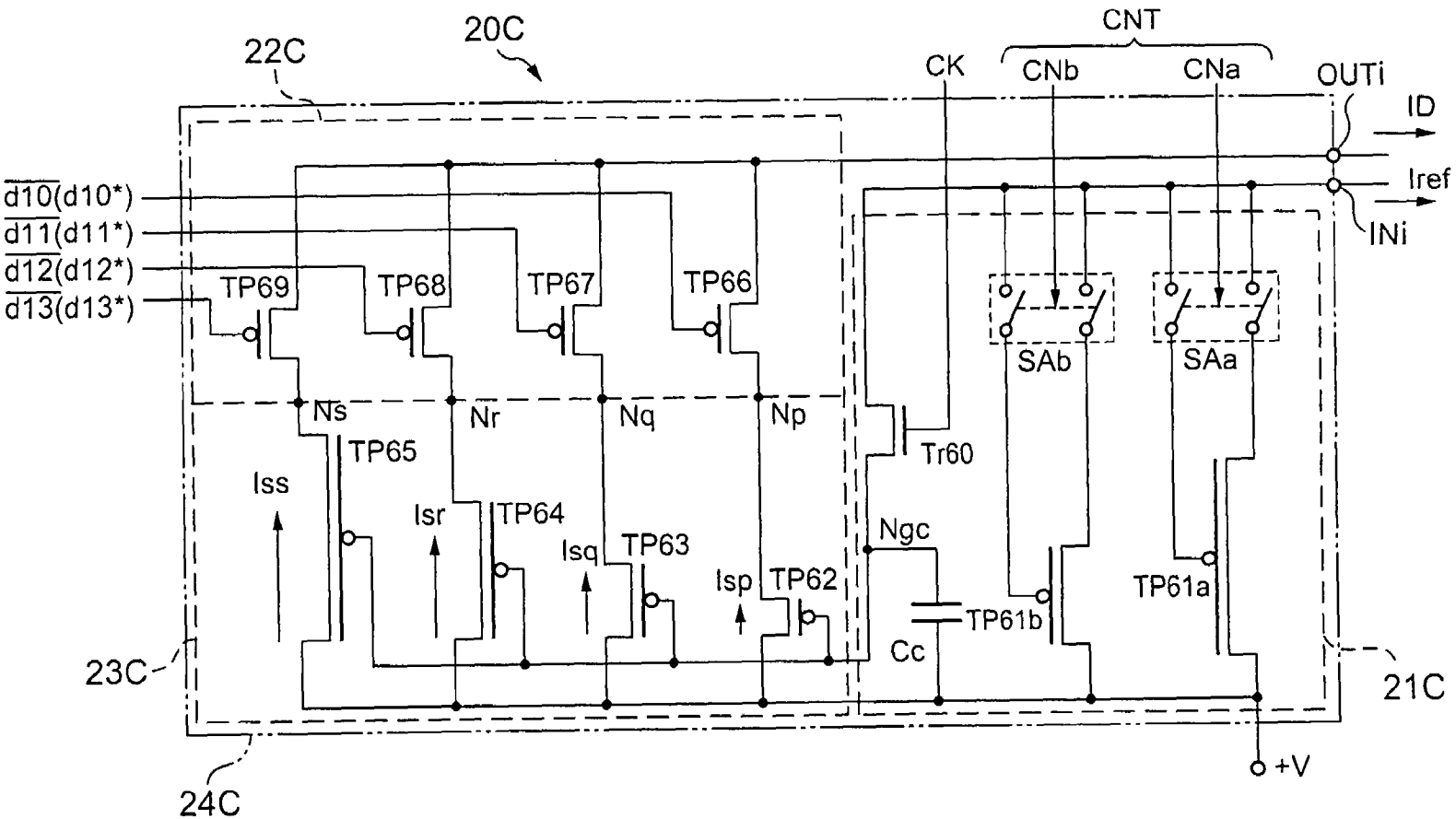
FIG. 15 is a configuration diagram showing an illustrative example of the current generation circuit in the gradation current generation supply circuit related to the embodiments.

FIG. 15 is a configuration diagram showing an illustrative example of the current generation circuit in the gradation current generation supply circuit related to the embodiments.

Here, the description will be made in connection with the configuration of the above-described current generation supply circuit (FIG. 2 and FIG. 3). Also, the configurations, which are the same as those in the above-described embodiment, will be given with the same reference numerals and symbols, and the description thereof will be made briefly or omitted.

The second embodiment of the data driver related to this embodiment comprises a pair of the gradation current generation supply circuits, which have, generally, a basic constitution of the current generation supply circuit ILA shown in FIG. 2. Relative to each of the plurality of data lines DL, and is configured so that each of the pair of gradation current generation supply circuits execute the operations of taking-in and holding of the display data and operation of generating and supplying the gradation current complementarily and continuously at predetermined operation timing. Here, in this embodiment, it is arranged so that, relative to each of the gradation current generation supply circuits, which are provided as a pair, negative reference current Iref having a constant current value is supplied in common from a single constant current generation source.

To be more precise, as shown in FIG. 13, the data driver 130B related to this embodiment comprises an inverted latch circuit 133B which generates non-inverted clock signals CKa and inverted clock signals CKb based on the shift clock signal SFC supplied as the data control signal from the system controller 140A, a shift register circuit 131B which sequentially outputs shift signals SR1, SR2, . . . (equivalent to the above-described timing control signal CLK: hereinafter, also referred to as "shift signals SR", for convenience) at predetermined timing while shifting the sampling start signals STR based on the non-inverted clock signals CKa and inverted clock signals CKb, a pair of gradation current generation supply circuits 132B and 132C which sequentially take in the display data d0-d3 for one line sequentially supplied from the display signal generation circuit based on the input timing of the shift signals SR1, SR2, . . . , from the shift register circuit 131B, corresponding to the light luminosity characteristic (gradation luminosity characteristic) which is set based on the control signals CNT supplied as data control signals from the system controller 140A, generates a gradation current Ipix corresponding to the light generation luminosity in each of the display pixels, and supplies (applies) the same via each data lines DL1, DL2, . . . , a selection setting circuit 134B which outputs selection setting signals (non-inverted signals SLa and inverted signals SLb of the switching control signal SEL) for selectively operating either one of the above gradation current generation supply circuits 132B and 132C based on switching control signal SEL supplied from the system controller 140A as data control signals, and a constant current generation source IR which supplies (supply to draw the negative polarity current) the constant reference current Iref via the reference current supply line Ls common to the gradation current generation supply circuits PXB1, PXB2, . . . and PXC1, PXC2, . . . (hereinafter, also referred to as "gradation current generation supply circuit sections PXB and PXC") constituting the gradation current generation supply circuits 132B and 132C.

(The Gradation Current Generation Supply Circuit)

AS shown in FIG. 14, the each of the gradation current generation supply circuit sections PXB and PXC constituting the gradation current generation supply circuits 132B and 132C comprises a data latch section 10 which has a configuration equivalent to the current generation supply circuit ILA (data latch section 10, current generation circuit 20A) shown in FIG. 2, and an operation setting section 40C which selectively sets the operation conditions of each of the gradation current generation supply circuits sections PXB and PXC based on selection setting signals (non-inverted signals SLa or inverted signals SLb), which are output from the current generation circuit 20C and the selection setting circuit 134B.

Here, as shown in FIG. 15, same as the current generation circuit 20A shown in FIG. 3, the current generation circuit 20C comprises a drive current generation circuit 24C which is comprised of a module current generation circuit 23C including a plurality of module current transistors TP62-TP65 comprising a p-channel type transistor, and a drive current generation circuit 24C comprised of a current selection circuit 22C including a plurality of switching transistors TP66-TP69 comprised of a p-channel type transistors; and in addition to reference current transistors TP61*a* and TP61*b* and switches SAa and SAb comprised of a p-channel type transistors, a reference voltage generation circuit 21C, which comprises arefresh control transistor (refresh circuit) Tr60 including an n-channel type transistor which controls the continuity condition between a current input contact INi and a contact Ngc based on a timing control signal CK (equivalent to non-inverted clock signals CLK shown in FIG. 2) output from the operation setting section 40C, which will be described later.

That is, owing to this refresh control transistor Tr60, at a timing when the timing control signals CK (non-inverted clock signals), which is output from the operation setting section 40C becomes high-level, the electrical charge based on the reference current Iref is supplied to the contact NgC and stored in a capacitor Cc; thus, the voltage of the contact NgC (i.e., the reference voltage, which is applied to the gate terminals of each of the module current transistors TP66-TP69) is recharged (refreshed) to a constant voltage. The refresh operation of the reference voltage will be described later.

As shown in FIG. 14, the operation setting section 40C, which is applied to the gradation current generation supply circuits PXC and PXD, has a configuration comprising an inverter 42 which performs inversion processing of a selection setting signal SEL (non-inverted signals SLa or inverted signals SLb), which is output from the selection setting circuit 134B, a p-channel type transistor TP41 of which data lines DL is provided with a current path, and to the control terminal, an inverted signal (output signal of the inverter 42) of the selection setting signals is applied, an NAND circuit 43 which inputs the inverted signal of the selection setting signal (non-inverted signals SLa or inverted signals SLb) and the shift signals SR from the shift register circuit 131B, an inverter 44 which performs inversion processing of the logic output of the NAND circuit 43, an inverter 45 which performs further inversion processing of the inverted output of the inverter 44, and a current supply control transistor TP46 comprised of a p-channel type transistor, of which supply line of the reference current Iref to the current generation circuit 20C, acurrent path is provided, and to the control terminal, the output signal of the inverter 45, is applied.

In each of the gradation current generation supply circuit sections PXB and PXC, which has the configuration as described above, when a selection setting signals (non-inverted signals SLa or inverted signals SLb) of selection level (high-level) is input to the operation setting section 40C from the selection setting circuit 134B, the signal polarity is inverted and applied by the inverter 42 and p-channel type transistor TP41 performs an "ON" operation; thus, the current output terminal OUTi of the current generation circuit 20C is connected to the data lines DL via the p-channel type transistor TP41. Here, at the same time, owing to the NAND circuit 43 and inverters 44 and 45, irrespective of the output timing of the shift signals SR, a low-level timing control signals (non-inverted clock signals) is continuously input to the non-inverted input terminals CK of the data latch section 10; also, to the control terminal of the inversion input terminals CK* and p-channel type transistor TP46, a high-level timing control signals (inverted clock signals) are continuously input. Thus, the inverted output signals d10*-d13* based on the display data d0-d3 held in the data latch section 10 is supplied to the gradation current generation supply circuit 20C, and the supply of the reference current Iref to the gradation current generation supply circuit 20C is shut off.

On the other hand, when a selection setting signal (non-inverted signals SLa or inverted signals SLb) of non-selection level (low-level) is input from the selection setting circuit 134B, the signal polarity is inverted and applied by the inverter 42. Thereby, the p-channel type transistor TP41 performs an "OFF" operation, and the current output terminal OUTi of the gradation current generation supply circuit 20C is isolated from the data lines DL. At the same time, owing to the NAND circuit 43 and the inverters 44 and 45, corresponding to the output timing of the shift signal SR, to the non-inverted input terminals CK of the data latch section 10, a high-level timing control signal is input; and to the control terminal of the inversion input terminals CK* and the p-channel type transistor TP46 a low-level timing control signal is input. Thus, the display data d0-d3 is taken in and held by the data latch section 10, and the reference current Iref is supplied to the current generation circuit 20C.

Owing to this, when a selection level selection setting signal is input, based on the inverted output signals d10*-d13*, which is output from the data latch section 10, in the current generation circuit 20C, the gradation currents Ipix corresponding to the display data d0-d3 is generated, and supplied to the display pixels via the data lines DL; thus, the gradation current generation supply circuit section PXB or PXC is set to the selection state.

On the other hand, when a non-selection level selection setting signal is input, in the data latch section 10, although the display data d0-d3 are taken-in and held, the gradation currents Ipix are not generated, and thus not supplied to the data lines DL. Accordingly, the gradation current generation supply circuit section PXB or PXC is set to the non-selection state. In this non-selection state, the reference current Iref is supplied to the gradation current generation supply circuit 20C, a refresh operation is executed to recharge the potential at the gate terminal (contact Ngc) of the reference current transistor TP61*a* or TP61*b* to predetermined voltage.

Accordingly, using the selection setting circuit 134B, which will be described later, by appropriately setting the signal levels of the selection setting signals (non-inverted signals SLa or inverted signals SLb switching control signal SEL), which are input to the pair of gradation current generation supply circuit group 132B and 132C, either one of the pair of gradation current generation supply circuit-group 132B and 132C can be set to the selection state and the other can be set to the non-selection state.

(The Inverted Latch Circuit/selection Setting Circuit)

To describe schematically, in the inverted latch circuit 133B or selection setting circuit 134B, when a shift clock signal SFC or a switching control signal SEL is applied, the signal level is held and the non-inverted signal and the inverted signal of the signal level are output from the non-inverted output terminal and the inverted output terminal respectively; thus, there are supplied to the shift register circuit 131B as the non-inverted clock signal CKa and the inverted clock signal CKb, and to the gradation current generation supply circuit 132B (each of the gradation current generation supply circuits PXB1 and PXB2, . . . ) and gradation current generation supply circuit 132C (each of the gradation current generation supply circuit sections PXC1 and PXC2, . . . ) as the non-inverted signal SLa and inverted signal SLb (selection setting signal).

(Shift Register Circuit)

Based on the non-inverted clock signal CKa and the inverted clock signal CKb, which are output from the above-described inverted latch circuit 133B, the shift register circuit 131B takes in the shift start signal STR supplied from the system controller 140A, and while sequentially shifting at predetermined timing, outputs the shift signals SR1 and SR2, . . . to the gradation current generation supply circuits 132B and 132C.

(The Control Operation of the Data Driver)

Next, referring to drawings, the operation of the data driver of this embodiment and display device including the same will be described.

Figure 16:
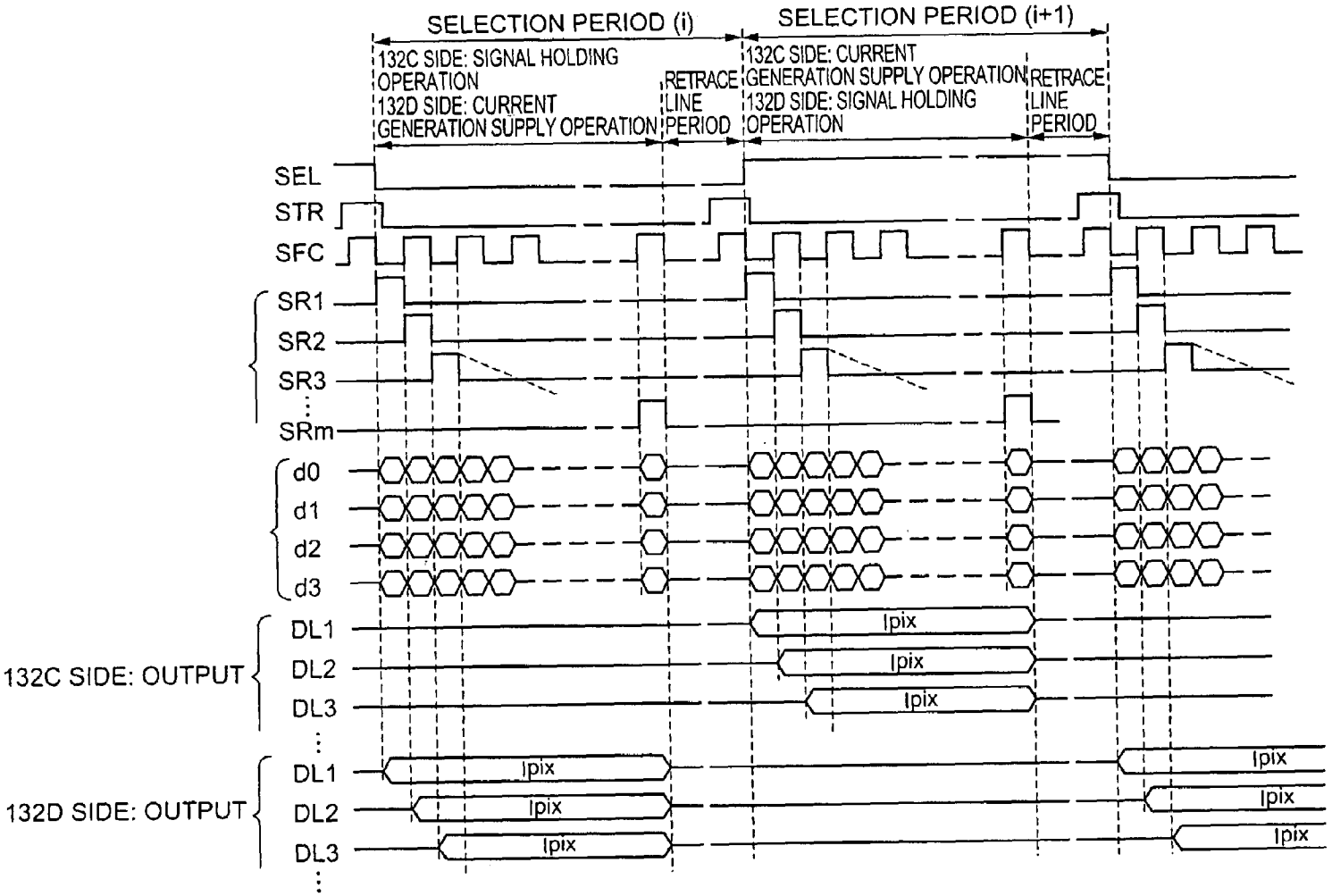
FIG. 16 is a timing chart showing an example of the control operations in the second embodiment of the data driver related to the embodiments.

FIG. 16 is a timing chart showing an example of the control operations in the second embodiment of the data driver related to the embodiments.

The control operation in the data driver 130B as described above is executed as described below. That is, as shown in FIG. 16, when a non-selection level (low-level) selection setting signal is input, in the signal holding operation period, in which the display data d0-d3 are taken in and held in the data latch section 10 of the gradation current generation supply circuit section PXB or PXC, both of the refresh control transistor Tr60 provided in the reference voltage generation circuit 21C and the current supply control transistor TP46 provided in the operation setting section 40C perform ON-operation. Thereby, the reference current Iref flows to the current path of the reference current transistor TP61*a* or TP61*b*, the electrical charge based on the reference current Iref is supplied to the gate terminal and contact Ngc of the reference current transistor TP61*a* or TP61*b*. Owing to this, an electrical charge corresponding to the reference current Iref is accumulated (charge) in the capacitor Cc, the potential of the gate terminal is refreshed to a predetermined voltages (reference voltages Vref). At this time, the p-channel type transistor TP41 provided in the operation setting section 40C is in the OFF state. Accordingly, the gradation currents Ipix are not supplied from the current generation circuit 20C to the data lines DL.

Also, when the selection level (high-level) selection setting signal is input to the data driver 130B, in the current generation supply operation period when, in each of the gradation current generation supply circuit sections PXB and PXC, based on the taken in and held display data d0-d3, the gradation currents are generated and supplied, both of the refresh control transistor Tr60 and the current supply control transistor TP46 perform an "OFF" operation. Thereby, the supply of electrical charge to the gate terminal and the contact Ngc of the reference current transistor TP61*a* or TP61*b* is shut off.

At this time, owing to the voltage component charged in the capacitor Cc, the potential (reference voltages) of the contact Ngc is held to predetermined voltages. Accordingly, each module current, which is generated by the module current generation circuit 23C based on the display data d0-d3 in each of the gradation current generation supply circuit sections PXB and PXC, is selectively integrated by the current selection circuit 22C; thus, the gradation currents Ipix having the desired current values are generated. Owing to this, the gradation currents Ipix having current values corresponding to the display data d0-d3 is continuously supplied to each of the display pixels via the data lines DL from each of the gradation current generation supply circuit sections PXB and PXC.

That is, as shown in FIG. 16, the signal holding operation and the current generation supply operation as described above are alternately executed repeatedly by the pair of gradation current generation supply circuits 132B and 132C at predetermined period. Thereby, for example, in a non-selection period of the one gradation current generation supply circuit 132B, while executing the signal holding operation to take in the display data d0-d3; at the same time, in a selection period for setting in the other gradation current generation supply circuit 132C, the current generation supply operation to generate and supply the gradation currents Ipix based on the display data d0-d3, which has been taken in the previous timing, is executed in parallel.

Then, in the selection period of the one gradation current generation supply circuit 132B, while executing the current generation supply operation based on the display data d0-d3, which has been taken in the previous non-selection period; at the same time, in the non-selection period set on the other gradation current generation supply circuit 132C, a sequential operation of signal holding operation to take in the next display data d0-d3 is repeatedly executed alternately.

Accordingly, to each data line, a pair of gradation current generation supply circuit (group) is provided, and the operation condition of each gradation current generation supply circuit is repeatedly executed alternately. The gradation currents having current values appropriately corresponding to the display data can be continuously supplied from the data driver to each of the display pixels. Thus, it is possible to make the display pixels perform the light generation operation swiftly at predetermined luminosity gradations resulting in a further increased display response speed of the display device and display quality.

Further, it is possible to periodically recharge (refresh) the potential (reference voltage), which is applied to the gate terminal (contact Ngc) of the module current transistors TP62-TP65, which constitutes the module current generation circuit 23C in each of the gradation current generation supply circuit sections PXB and PXC, to a predetermined constant voltage. Accordingly, the reduction of the reference voltage caused by current leak and the like in the module current transistor can be prevented. Therefore, it is possible to reduce a phenomenon such that, due to the unevenness of the continuity condition in each module current transistor, gradation currents (i.e., luminosity gradations of the display pixels) becomes uneven, resulting in a satisfactory gradation display operation (improvement of the display quality).

Furthermore, in the data driver related to this embodiment and the display device including the same also, based on the control signals CNT (switching control signals CNa and CNb) output from the system controller 140A, gradation-current characteristic of the gradation currents Ipix, which are generated by each of the gradation current generation supply circuit sections PXB and PXC, is switched over to control. Accordingly, the same as the case shown in FIG. 12, two types of gradation-luminosity characteristics, which represent the changes of the light generation luminosity relative to the specified gradations in the display pixels (light emitting devices), can be set. By appropriately changing these gradation-luminosity characteristics to be set the same, it is possible to make the display pixels perform the light generation operation at appropriate light generation luminosity corresponding to the application conditions (ambient luminosity) and the like of the display device, thus, the desired image information can be displayed with a satisfactory visibility.

<The Third Embodiment of the Display Device>

Next, a third embodiment of a data driver related to this embodiment and display device including the same will be described.

In the above-embodiments, the following configuration and control method have been described. That is, in the reference voltage generation circuit in the current generation circuit of the gradation current generation supply circuit in the data driver, the plurality of reference current transistors having different transistor sizes are provided, and by appropriately changing over and controlling these transistors selectively, the voltages generated at the gate terminal of each reference current transistors are controlled to be different from each other relative to the constant reference current. Thereby, the current values of the module currents, which are generated corresponding to the plurality of bit digital signals based on the display data, are set to be different from each other, i.e., the ratio of the current values of the module currents relative to the reference current are different from each other, thereby, the current characteristics of the gradation currents and the luminosity characteristics of the light emitting devices relative to the specified gradation are changed and set. In the present invention, the above technical idea may be applied to gradation current generation supply circuits, which are provided corresponding to the light emitting devices for colors of red (R), green (G) and blue (B) used for displaying image information in color optimizing the gradation-luminosity characteristics. Hereinafter, description will be made more precisely.

Figure 17:
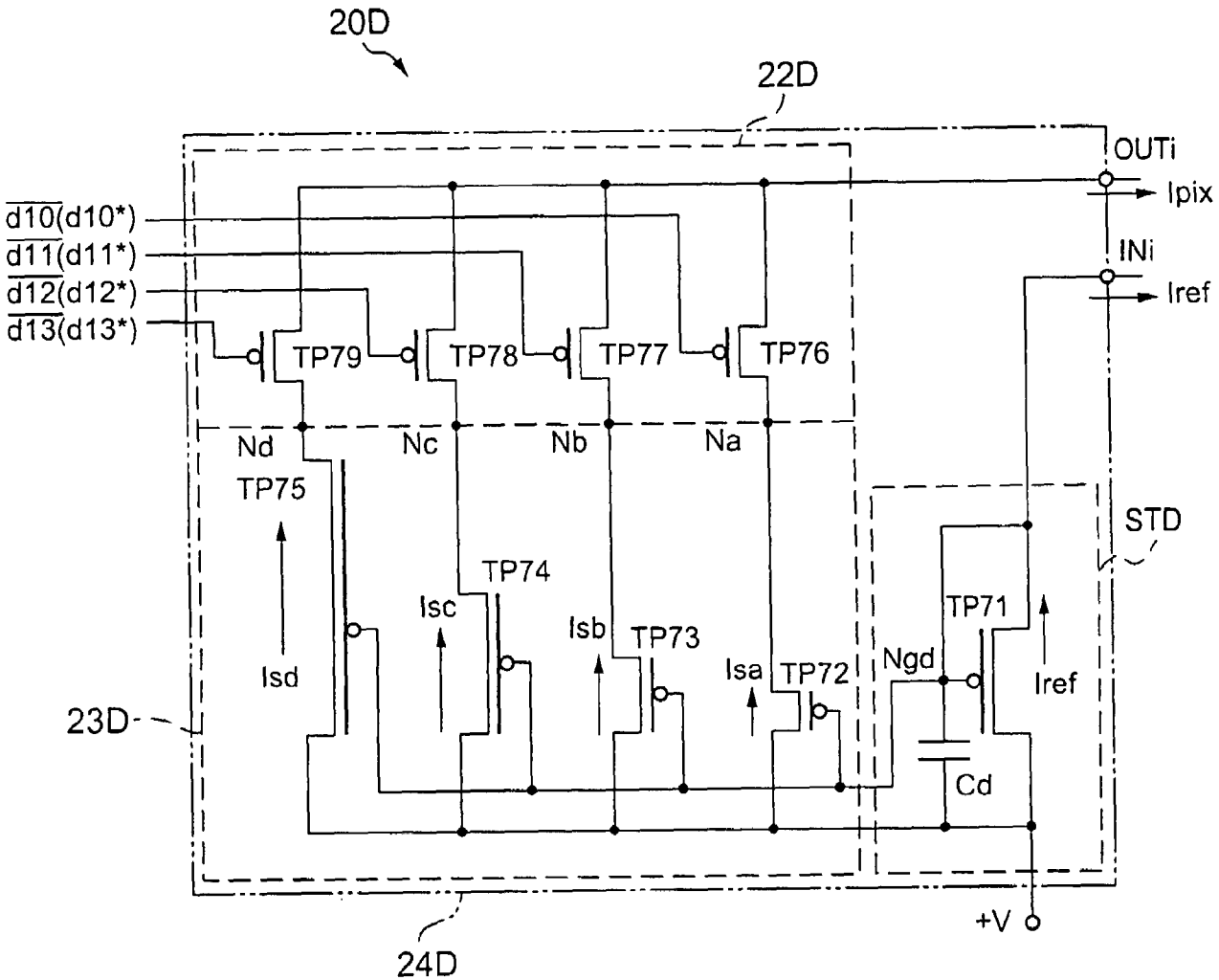
FIG. 17 is a circuit configuration diagram showing an example of the current generation circuit applicable to the gradation current generation supply circuit in the third embodiment of the data driver related to the embodiments.

FIG. 17 is a circuit configuration diagram showing an example of the current generation circuit applicable to the gradation current generation supply circuit in the third embodiment of the data driver related to the embodiments.

Figure 18C:
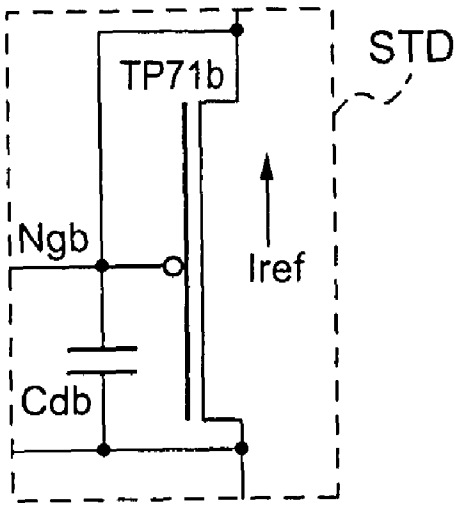
FIGS. 18A, 18B and 18C are circuit diagrams showing the reference voltage generation circuit applicable to the gradation current generation supply circuit related to the embodiments.
Figure 18B:
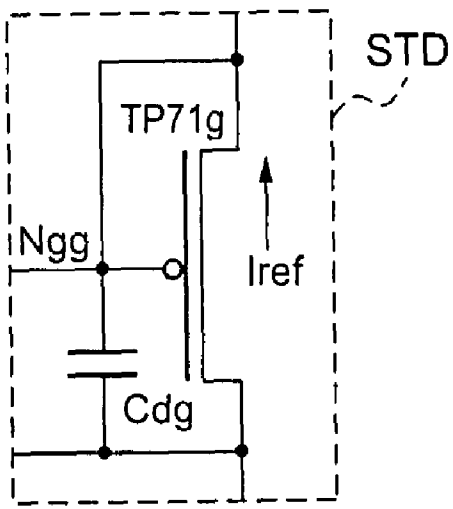
Figure 18A:
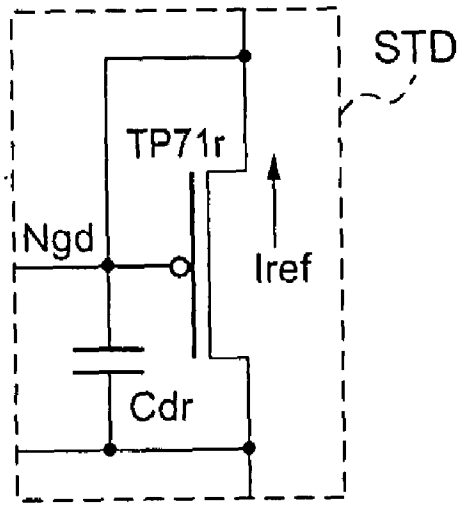

FIGS. 18A, 18B and 18C are circuit diagrams showing the reference voltage generation circuit applicable to the gradation current generation supply circuit related to the embodiments.

Figure 19A:
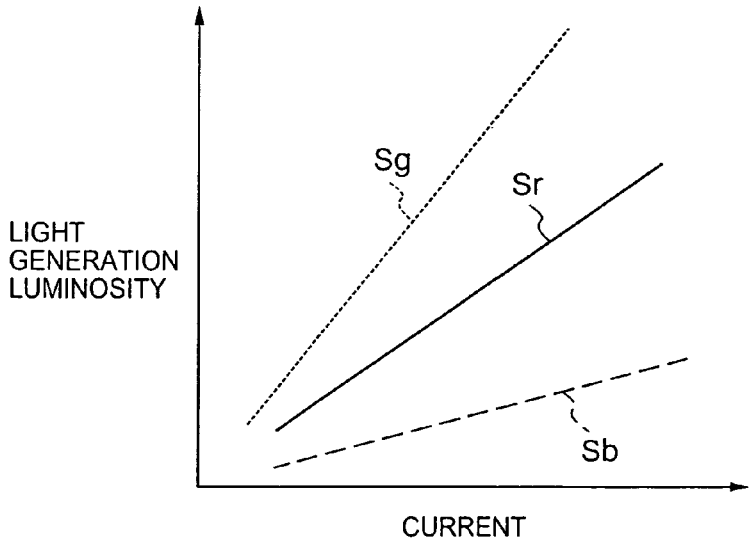
FIGS. 19A and 19B are diagrams showing the current-luminosity characteristic and the gradation-luminosity characteristic in each of the luminescent colors RGB of the light emitting devices applicable to the display device related to the embodiments.
Figure 19B:
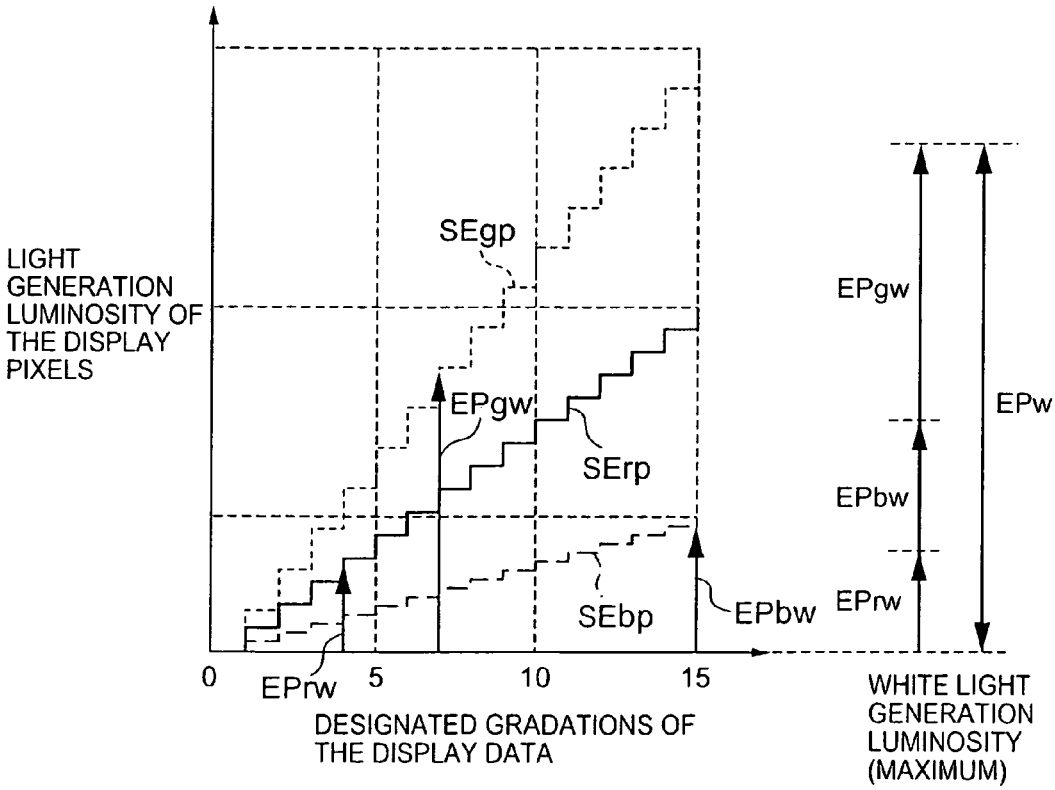

FIGS. 19A and 19B are diagrams showing the current-luminosity characteristic and the gradation-luminosity characteristic in each of the luminescent colors RGB of the light emitting devices applicable to the display device related to the embodiments.

Figure 20:
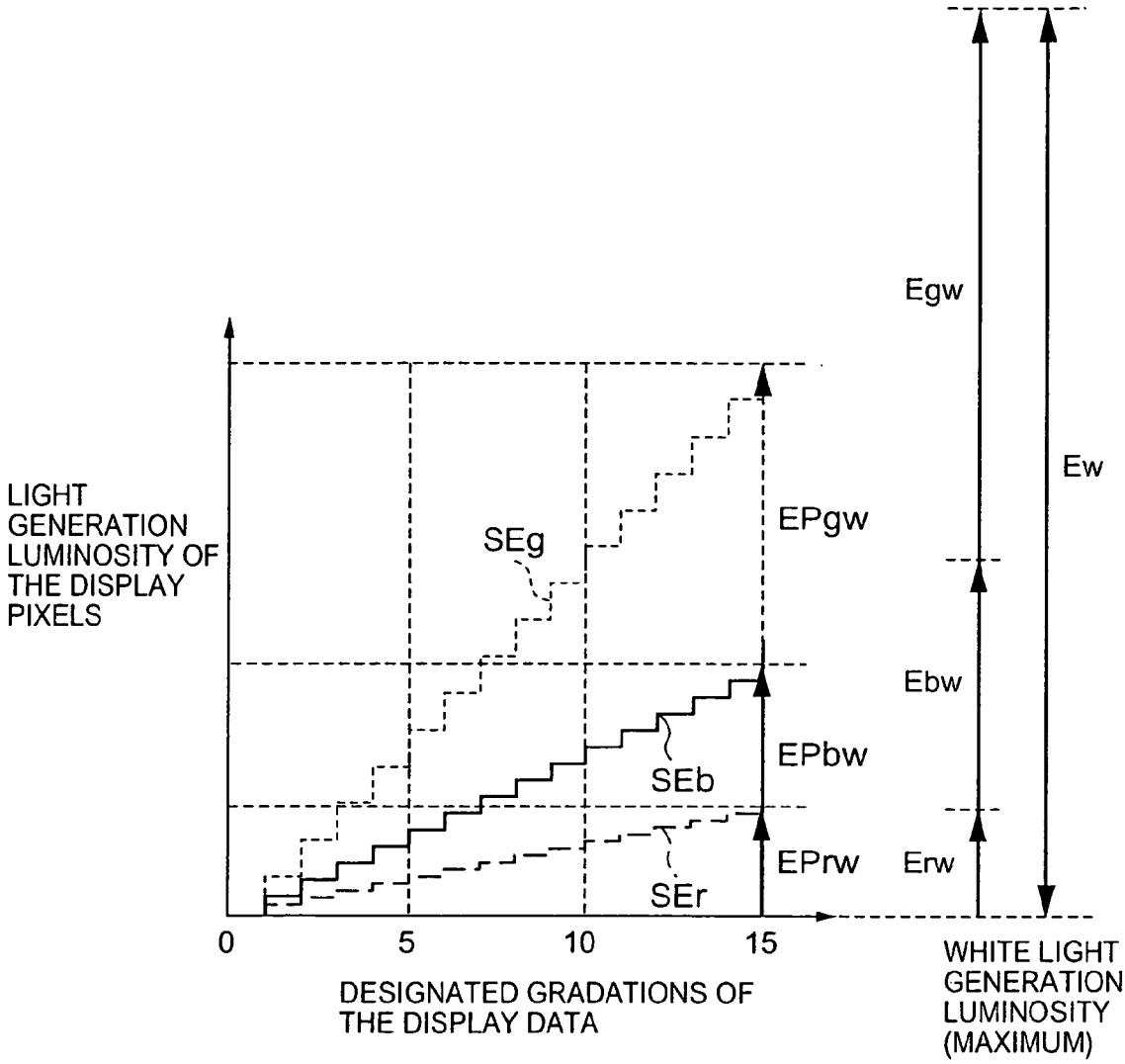
FIG. 20 is a diagram showing the gradation-luminosity characteristic in each of the luminescent colors RGB of the light emitting devices related to the embodiments and showing a diagram of the white balance setting concept.

FIG. 20 is a diagram showing the gradation-luminosity characteristic in each of the luminescent colors RGB of the light emitting devices related to the embodiments and showing a diagram of the white balance setting concept.

Here, a configuration, which is equivalent to the configuration of the current generation circuit in the current generation supply circuit shown in FIG. 3 to which the technical idea related to the invention is applied, is shown. The configuration of the same components will be given with the same or equivalent reference numerals and symbols, and the descriptions thereof will be made briefly or omitted.

As shown in FIG. 17, the current generation circuit 20D, which is applied to the gradation current generation supply circuit in the data driver related to this embodiment, has a circuit configuration including; substantially the same as that of the current generation circuit 10A shown in FIG. 3, between the high potential power supply +V and the current input contact INi, a reference voltage generation circuit STD including a reference current transistor TP71 comprised of p-channel type transistors and a capacitor Cd; a module current generation circuit 24D including a plurality of module current transistors TP72-TP75 comprised of p-channel type transistors; and a current selection circuit 22D including a plurality of switching transistors TP76-TP79 comprised of p-channel type transistors.

Here, based on the gradation currents Ipix generated by the current generation circuit 20D, the reference current transistor TP71 constituting the reference voltage generation circuit STD is determined as described below in accordance with the light color emitted from the light emitting devices. For example, for the light emitting devices of which the color of the emitted light is red, as shown in FIG. 18A, a circuit configuration which includes a p-channel type transistor TP71*r* of which channel width is arranged to be relatively shorter is employed. For the light emitting devices of which color of the emitted light is blue, as shown in FIG. 18C, a circuit configuration that includes a p-channel type transistor TP71*b* of which channel width is arranged to be relatively longer is employed. And for the light emitting device of which color of the emitted light is green, as shown in FIG. 18B, a circuit configuration which includes a p-channel type transistor TP71*g* of which channel width is arranged to be a intermediate length between the channel width of the light emitting devices of the reference current transistors (p-channel type transistors TP71*r* and TP71*b*) corresponding to the color of emitted light is red and blue, is employed.

Owing to this, in the display device including the data driver of this embodiment, in accordance with the each color of the light emitted from the light emitting devices, it is possible to set the channel width of the reference current transistor independently from each other; and thus, the ratio of each module current relative to the reference current can be set so as to be different from each other on the color basis of the light emitted. Accordingly, the current-luminosity characteristic of each light emitting devices in each color of the light emitted can be randomly changed and set to optimize the same.

The following facts are known. That is, in general, as demonstrated in current vs light luminosity characteristic in FIG. 19A, the light generation luminosity relative to the current in the light emitting device, which emits each color of RGB, light generation luminosity increases linearly in accordance with the increase of the current value of the current supplied to the light emitting devices; and the inclination, which indicates the tendency of the light generation luminosity in each color, is different from each other.

Referring to an example of the current-luminosity characteristic shown in FIG. 19A, when current having the same current value is supplied to the light emitting devices, the light generation luminosity of the green is high (characteristic line Sg), and recognized as relatively brighter. On the other hand, the light generation luminosity of the blue is relatively low (characteristic line Sb), and recognized as darker. And the light generation luminosity of the red is recognized as an intermediate brightness between the green and the blue (characteristic line Sr).

Accordingly, as the gradation current generation supply circuit (current generation circuit), which is provided independently corresponding to the light emitting devices of each RGB color in accordance with the color dependency of the current-luminosity characteristics of the light emitting devices as described above, for example, a circuit configuration which includes, in the current generation circuit 20D, the reference current transistor TP71 having the same channel width in the reference voltage generation circuit STD relative to the light emitting devices of each color as shown in FIG. 17 (i.e., a circuit configuration in which the ratio of the channel width between the reference current transistor TP71 and the module current transistors TP72-TP75 is constant relative to the light emitting devices of each color) is employed, the light generation luminosity (gradation-luminosity characteristic), which obtained corresponding to each specified gradation (gradation currents), exhibits different tendency in each color as shown in FIG. 19B. In FIG. 19B, SErp indicates the luminosity characteristic in the red light emitting element; SErg indicates the luminosity characteristic in the green light emitting element; and SErd indicates the luminosity characteristic in the blue light emitting element.

In a configuration to which gradation current generation supply circuits having the same circuit configuration corresponding to the light emitting devices of RGB colors are employed, in the case where white color light emission is obtained by mixing RGB three colors, as shown in FIG. 19B the specified gradation for each color is set based on the ratio of the light generation luminosity among the components constituting the white color light (white balance). That is, it is controlled so that, based on the reference of the light generation luminosity EPbw of the light emitting device of blue, of which light generation luminosity in the maximum gradation (15 gradations in FIG. 19B) is the lowest, light generation operation is carried out at a specified gradation different from each other, under which the light generation luminosity EPrw and EPgw of two other colors (red and green) are resulted in a predetermined ratio based on the white balance. Owing to this, the maximum value of the light generation luminosity EBw of the white color light is determined.

Accordingly, the gradation control in each RGB color for obtaining a satisfactory white balance to obtain a satisfactory white color light becomes complicated, and the maximum value of the light generation luminosity of the white color light is limited based on the gradation-luminosity characteristic of the light emitting device of which light generation luminosity at the maximum gradation is the lowest. The setting range for the light generation luminosity of the white color light becomes relatively narrow. Accordingly, there resides such problem that the maximum value of the light generation luminosity for the white color light is limited to a relatively low level.

Accordingly, in the current generation supply circuit related to this embodiment, as shown in FIG. 20, in order to obtain such ratio that the light generation luminosity of each RGB color at maximum gradation achieve a satisfactory white balance, the gradation-luminosity characteristics SEr, SEg and SEb of each RGB color are independently set. That is, the ratio of the light generation luminosities Erw, Egw and Ebw at the maximum gradation (15th gradation in FIG. 19B)

of each RGB color is set so that the satisfactory white balance shown in FIG. 19B is obtained. Using the gradation currents at the maximum gradations, which are generated by the current generation circuits in the gradation current generation supply circuit corresponding to each color, the channel width of each of the p-channel type transistors TP71*r*, TP71*g* and TP71*b* in each reference voltage generation circuit STD shown in FIGS. 18A-18C is set so that the above-described light generation luminosity Erw, Egw and Ebw, is obtained respectively.

Accordingly, in gradation current generation supply circuit including the current generation circuit, which comprises reference voltage generation circuits having a single reference current transistor, shown in FIG. 17, the channel width of the reference current transistor in each of the reference voltage generation circuit is set so that the gradation-luminosity characteristic of each of the light emitting devices of RGB colors are resulted is a desired characteristic respectively (SEr, SEg and SEb shown in FIG. 20). Thereby, as shown in FIG. 20, the white color light having a satisfactory white balance can be obtained at the maximum gradation of each color. In this case, the white color light can be obtained in the state that each color has the maximum luminosity. Therefore, compared to the configuration in which the channel width of the reference current transistors is the same as shown in FIG. 19B, the luminosity of the white color light emission (light generation luminosity Ew) can be increased resulting in an increased display quality.

<The Fourth Embodiment of the Display Device>

Next, a fourth embodiment of the data driver and the display device including the same will be described.

Figure 21:
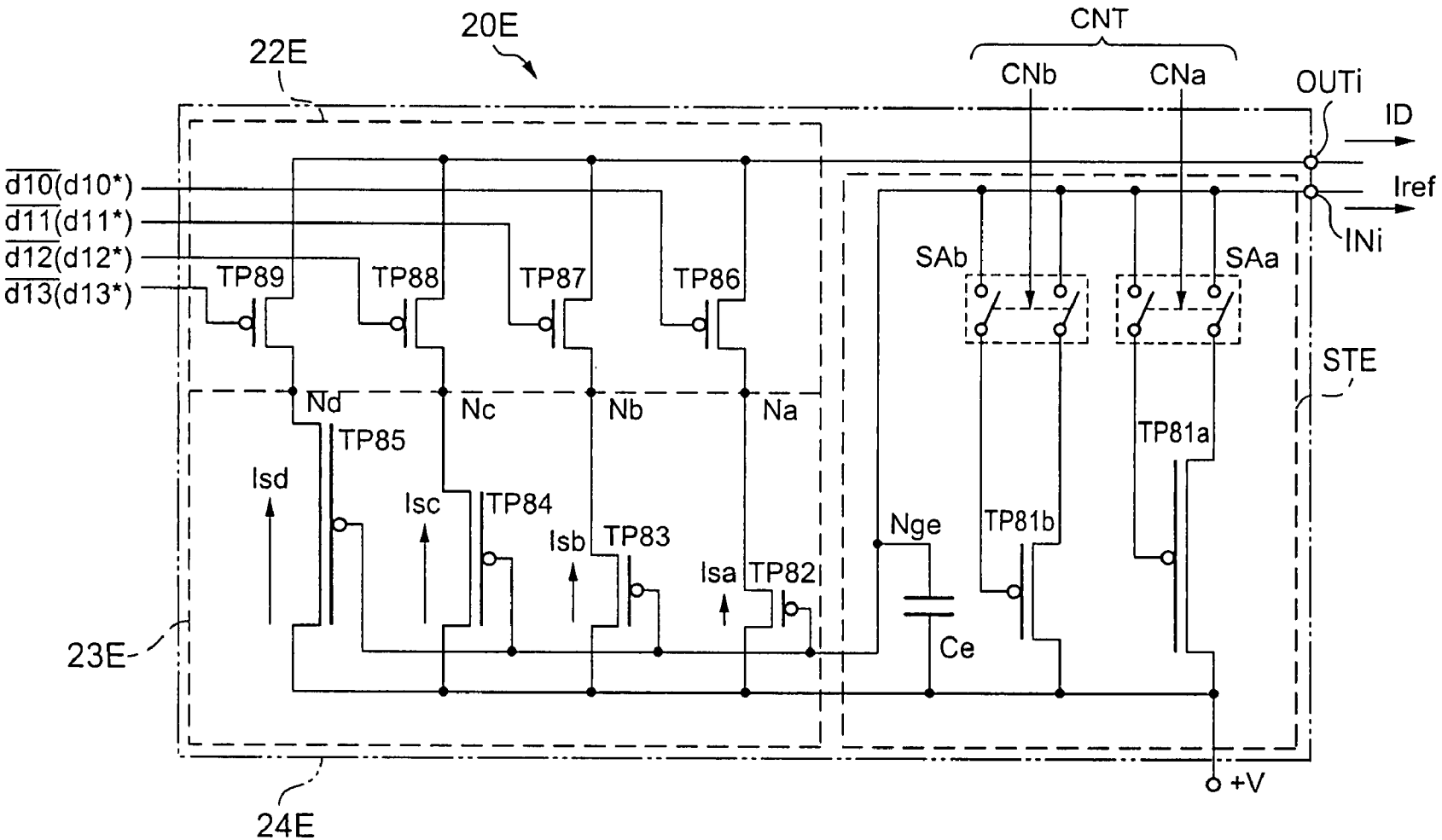
FIG. 21 is a circuit configuration diagram showing an embodiment of the current generation circuit applicable to the gradation current generation supply circuit in the fourth embodiment of the data driver related to the embodiments.

FIG. 21 is a circuit configuration diagram showing an embodiment of the current generation circuit applicable to the gradation current generation supply circuit in the fourth embodiment of the data driver related to the embodiments.

FIGS. 22A, 22B and 22C are circuit diagrams showing the principal part of the reference voltage generation circuit applicable to the gradation current generation supply circuit related to the embodiments.

Here, the current generation supply circuit shown in FIG. 3 and FIG. 17 will be appropriately referred to, and the configuration of the same components will be given with the same or equivalent reference numerals and symbols, and the descriptions thereof will be made briefly or omitted.

This embodiment has a configuration such that both of the following configurations are included; i.e., a configuration in which the channel width of each reference current transistor in each reference voltage generation circuit, which includes one reference current transistor in the gradation current generation supply circuit of the third embodiment in the above-described display device, is independently set corresponding to each color of RGB; and a configuration in which a plurality of reference current transistors, of which channel width is different from each other, is provided to the reference voltage generation circuit in the first and second embodiments of the above-described display device, the gradation-luminosity characteristic of the light emitting devices of the colors RGB is selectively switched over to adjust and set the same in accordance with the necessity.

That is, as shown in FIG. 21, the current generation circuit 20E, which is applied to a gradation current generation supply circuit related to this embodiment has a circuit configuration including, between the high potential power supply +V and the current input contact INi, a reference voltage generation circuit STE comprised of a plurality of reference current transistors TP81*a*, TP81*b* and capacitor Ce; a module current generation circuit 23E including a plurality of module current transistors TP82-TP85 comprised of p-channel type transistors; and a current selection circuit 22E including a plurality of switching transistors TP86-TP89 comprising p-channel type transistors.

As shown in FIGS. 22A-22C, the reference voltage generation circuit STE comprises a plurality of (in this embodiment; two kinds) p-channel type transistors (reference current transistors) TP81*ra* and TP81*rb*, TP81*ga* and TP81*gb* and TP81*ba* and TP81*bb*, which have a channel width different from each other for each RGB color; switches SAa and SAb, which connects either of these plural reference current transistors between the high potential power supply +V and the current input contact INi; and capacitors Cer, Ceg and Ceb, which are connected between the current input contact INi and the high potential power supply +V. The p-channel type transistors in the reference voltage generation circuit STE for each RGB color are switched over and controlled based on the control signals CNT (switching control signals CNa and CNb). Thereby, as shown in FIG. 12, the gradation-luminosity characteristic in the light emitting device for each RGB color is changed to set in a plurality of kinds. Also, as shown in FIG. 20, the gradation-luminosity characteristic for each RGB color is set so that the ratio of light generation luminosity of each color at the maximum gradation is in satisfactory white balance.

According to the gradation current generation supply circuit which has the configuration as describe above, using a simple control method for setting and controlling the control signals CNT, by switching and controlling the ratio of the module currents (gradation currents) relative to the reference current in the current generation circuit, the gradation-luminosity characteristic in the display pixels (light emitting devices) can be changed and set without changing current value of the reference current. Accordingly, it is possible to make the display pixels perform the light generation operation with an appropriate light generation luminosity corresponding to the operation conditions (ambient luminance) and the like for the display device, thus desired image information can be displayed with satisfactory visibility. Further, the gradation-luminosity characteristic of the light emitting devices for each RGB color, which is set by the switching control signal, is set so that white color emission having a satisfactory white balance is obtained at the maximum gradation of each color. Accordingly, it is possible to obtain white color emission with higher luminosity resulting in further increased display quality.

In the above-described embodiment, only a configuration, in which a pair of the reference current transistors for selectively flowing the constant reference current is provided has been described. However, the invention is not limited to the above. It is needless to say that a plurality of reference current transistors may be further provided for allowing selection from a plurality of gradations-gradation current characteristics (or, gradation luminosity characteristics).

As for the technique to switch over and control the plural reference current transistors, a technique, in which the continuity of the switch provided in the current path of each reference current transistor is selectively controlled based on the control signal, has been demonstrated. However, the generating technique of the control signal is not particularly limited. For example, a user of an electronic apparatus mounted with the display devices may be allowed to operate manually; thereby the control signal may is generated by the system controller and the like. Or, a luminance sensor or the like for detecting ambient luminance may be provided, and based on the detected signal the control signal may be generated.

While the present invention has been described with reference to the preferred embodiments, it is intended that the invention be not limited by any of the details of the description thereof.

As this invention can be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

What is claimed is:

1. A current generation supply circuit which supplies drive currents corresponding to digital signals for a plurality of loads comprising:

a current generation circuit which supplies output currents to each of the plurality of loads as the drive currents, the current generation circuit comprising:

a reference voltage generation circuit which includes a plurality of reference current transistors having transistor sizes different from each other, wherein at least a reference current having a constant current value is supplied and the reference voltage generation circuit generates a plurality of reference voltages having different voltage values based on the reference current to each of the plurality of loads;

a drive current generation circuit which generates the output currents having a ratio of current values corresponding to the digital signals relative to the reference current based on the reference voltages; and a characteristic control circuit which includes a changeover switch that selectively flows the reference current to one of the plurality of reference current transistors and which sets the ratio of the output currents relative to the reference current in a plurality of stages by the changeover switch.

2. The current generation supply circuit according to claim 1, wherein the current generation circuit sets in order to flow the drive currents in a direction from a side of the loads.

3. The current generation supply circuit according to claim 1, wherein the current generation circuit sets in order to flow the drive currents in a direction to a side of the loads.

4. The current generation supply circuit according to claim 1, wherein the characteristic control circuit comprises means for changing the ratio of the output currents of the reference current to each of the plurality of loads.

5. The current generation supply circuit according to claim 1, wherein the reference voltage generation circuit comprises a charge storage circuit which stores electrical charges corresponding to the current value of the reference current.

6. The current generation supply circuit according to claim 5, wherein the reference voltage generation circuit comprises a refresh circuit which refreshes a charge amount accumulated in the charge storage circuit to a charge amount corresponding to the reference current at each predetermined timing.

7. The current generation supply circuit according to claim 1, wherein the drive current generation circuit comprises:

a module current generation circuit which generates a plurality of module currents having a ratio of current values different from each other relative to the reference current based on the reference voltages; and a current selection circuit which selectively integrates the plurality of module currents and generates the output currents.

8. The current generation supply circuit according to claim 7, wherein the current values of the plurality of module currents have a different ratio from each other defined by $2^n$, wherein n=0, 1, 2, 3, . . . .

9. The current generation supply circuit according to claim 7, wherein the module current generation circuit comprises a plurality of module current transistors having transistor sizes different from each other and with each control terminal connected in common.

10. The current generation supply circuit according to claim 9, wherein the plurality of module current transistors have a channel width set at a different ratio from each other defined by $2^n$, wherein n=0, 1, 2, 3, . . . .

11. The current generation supply circuit according to claim 9, wherein each control terminal of the plurality of module current transistors is connected to a control terminal of each of the reference current transistors; and wherein the reference current transistors and the module current transistors are comprised by a current mirror circuit.

12. The current generation supply circuit according to claim 7, wherein the current selection circuit comprises a selection switch which selectively integrates the plurality of module currents and generates the output currents.

13. The current generation supply circuit according to claim 1, further comprising a signal holding circuit which holds each bit value of the digital signals.

14. The current generation supply circuit according to claim 13, wherein the signal holding circuit comprises a plurality of latch circuits which individually hold the bit values of the digital signals.

15. The current generation supply circuit according to claim 13, wherein the drive current generation circuit generates the output currents corresponding to the bit values of the digital signals held in the signal holding circuit.

16. The current generation supply circuit according to claim 13, wherein the drive current generation circuit comprises:

a module current generation circuit which generates a plurality of module currents having a ratio of current values different from each other relative to the reference current based on the reference voltages, and a current selection circuit which selectively integrates the plurality of module currents and generates the output currents corresponding to the bit values of the digital signals held in the signal holding circuit.

17. The current generation supply circuit according to claim 16, wherein the current selection circuit comprises a selection switch which selects the plurality of module currents corresponding to the bit values of the digital signals held in the signal holding circuit.

18. The current generation supply circuit according to claim 16, wherein the current values of the plurality of module currents have a different ratio from each other defined by $2^n$, wherein n=0, 1, 2, 3, . . . .

19. The current generation supply circuit according to claim 1, wherein the plurality of loads comprise current control type light emitting devices which execute a light generation operation by predetermined luminosity gradations corresponding to the current values of the drive currents.

20. The current generation supply circuit according to claim 19, wherein the light emitting devices comprise organic electroluminescent devices.

21. A display device which displays image information corresponding to display signals derived from digital signals comprising:

a display panel comprising a plurality of scanning lines and a plurality of signal lines which intersect perpendicularly with each other and a plurality of display pixels arranged in matrix form near intersecting points of the scanning lines and the signal lines;

a scanning driver circuit which sequentially applies a scanning signal to each of the plurality of scanning lines for setting the plurality of display pixels in a selective state a line at a time; and a signal driver circuit comprising a plurality of gradation current generation supply circuits which supply output currents as gradation currents to the plurality of display pixels set in the selective state via each of the signal lines, wherein each of the plurality of gradation current generation supply circuits comprises a current generation circuit comprising:

a reference voltage generation circuit which includes a plurality of reference current transistors having transistor sizes different from each other, wherein at least a reference current having a constant current value is supplied and the reference voltage generation circuit generates a plurality of reference voltages having different voltage values based on the reference current to each of the plurality of signal lines;

a drive current generation circuit which generates the output currents having a ratio of current values corresponding to gradation values of the display signals relative to the reference current based on the reference voltages; and a characteristic control circuit which includes a changeover switch that selectively flows the reference current to one of the plurality of reference current transistors and which sets the ratio of the output currents relative to the reference current in a plurality of stages by the changeover switch.

22. The display device according to claim 21, wherein the current generation circuit sets in order to flow the gradation currents in a direction from a side of the display pixels via the signal lines.

23. The display device according to claim 21, wherein the current generation circuit sets in order to flow the gradation currents in a direction to a side of the display pixels via the signal lines.

24. The display device according to claim 21, wherein the reference voltage generation circuit comprises a charge storage circuit which stores electrical charges corresponding to the current value of the reference current.

25. The display device according to claim 24, wherein the reference voltage generation circuit comprises a refresh circuit which refreshes a charge amount accumulated in the charge storage circuit to a charge amount corresponding to the reference current at each predetermined timing.

26. The display device according to claim 21, wherein the drive current generation circuit comprises:

a module current generation circuit which generates a plurality of module currents having a ratio of current values different from each other relative to the reference current based on the reference voltages; and a current selection circuit which selectively integrates the plurality of module currents and generates the output currents.

27. The display device according to claim 26, wherein the current values of the plurality of module currents have a different ratio from each other defined by $2^n$, wherein n=0, 1, 2, 3, . . . .

28. The display device according to claim 26, wherein the module current generation circuit comprises a plurality of module current transistors having transistor sizes different from each other and with each control terminal connected in common.

29. The display device according to claim 28, wherein the plurality of module current transistors have a channel width set at a different ratio from each other defined by $2^n$, wherein n=0, 1, 2, 3,. . . .

30. The display device according to claim 28, wherein each control terminal of the plurality of module current transistors is connected to a control terminal of each of the reference current transistors; and wherein the reference current transistors and the module current transistors are comprised by a current mirror circuit.

31. The display device according to claim 26, wherein the current selection circuit comprises a selection switch which selectively integrates the plurality of module currents and generates the output currents.

32. The display device according to claim 21, wherein each of the gradation current generation supply circuits comprises a signal holding circuit which holds each bit value of the display signals derived from the digital signals.

33. The display device according to claim 32, wherein the signal holding circuit comprises a plurality of latch circuits which individually hold the bit values of the display signals.

34. The display device according to claim 32, wherein the drive current generation circuit generates the output currents corresponding to the bit values of the display signals held in the signal holding circuit.

35. The display device according to claim 32, wherein the drive current generation circuit comprises:

a module current generation circuit which generates a plurality of module currents having a ratio of current values different from each other relative to the reference current based on the reference voltages, and a current selection circuit which selectively integrates the plurality of module currents and generates the output currents corresponding to the bit values of the display signals held in the signal holding circuit.

36. The display device according to claim 35, wherein the current selection circuit comprises a selection switch which selects the plurality of module currents corresponding to the bit values of the display signals held in the signal holding circuit.

37. The display device according to claim 35, wherein the current values of the plurality of module currents have a different ratio from each other defined by $2^n$, wherein n=0, 1, 2, 3, . . . .

38. The signal driver circuit of the display device according to claim 32, wherein the plurality of the gradation current generation supply circuits are arranged in parallel relative to each of the signal lines.

39. The display device according to claim 38, wherein the plurality of gradation current generation supply circuits execute alternately in parallel (i) an operation that generates the output currents based on the bit values of the display signals held in the signal holding circuits in the drive current generation circuits of a first section of the gradation current generation supply circuits, and (ii) an operation which successively holds bit values of the display signals in the signal holding circuits of a second section of the gradation current generation supply circuits.

40. The display device according to claim 38, wherein the gradation current generation supply circuits are arranged in parallel in pairs relative to each of the signal lines and execute alternately in parallel (i) an operation which generates the output currents based on the bit values of the display signals held in the signal holding circuits in the drive current generation circuits of the gradation current generation supply circuits of a first side; and (ii) an operation which successively holds bit values of the display signals in the signal holding circuits of the gradation current generation supply circuits of a second side.

41. The display device according to claim 21, wherein the display pixels comprise current control type light emitting devices which execute a light generation operation by predetermined luminosity gradations corresponding to the current values of the gradation currents.

42. The display device according to claim 41, wherein the display pixels comprise pixel driver circuits which hold the gradation currents, generate light generation drive currents, and supply the light emitting devices based on the held gradation currents.

43. The display device according to claim 41, wherein the light emitting devices comprise organic electroluminescent devices.

44. The display device according to claim 41, wherein the characteristic control circuit comprises means for changing the ratio of the output currents relative to the reference current in each of the gradation current generation supply circuits and for changing the light generation luminosity characteristic between the light emitting devices in the plurality of display pixels.

45. The display device according to claim 41, wherein the light emitting devices of the plurality of display pixels have any of luminescent colors red, green and blue; and the characteristic control circuit sets the ratio of the output currents relative to the reference current in each of the gradation current generation supply circuits so that the light generation luminosity of the luminescent colors red, green and blue of the light emitting devices have a predetermined white balance in specified gradation values of the display signals.

46. The display device according to claim 45, wherein the characteristic control circuit sets the ratio of the output currents relative to the reference current so that the light generation luminosity of the luminescent colors red, green and blue of the light emitting devices have the predetermined white balance in maximum gradation values of the display signals.

47. A drive method of a display device which displays image information corresponding to display signals derived from digital signals on a display panel comprising a plurality of display pixels, the method comprising:

accumulating a charge amount in a charge storage circuit corresponding to a current component of a reference current by selecting one of a plurality of reference current transistors having transistor sizes different from each other and supplying the reference current having a constant current value to the selected reference current transistor;

setting current values of output currents which flow to an output current transistor by controlling a continuity condition in the output current transistor based on a voltage component corresponding to the charge amount accumulated in the charge storage circuit; and changing a ratio setting of the output currents for each display gradation;

taking in and holding each bit value of the display signals;

generating the output currents relative to each of the plurality of display pixels corresponding to each bit value of the display signals held based on the ratio of the output currents relative to the reference current wherein the ratio setting has been changed; and supplying the output currents generated to each of the plurality of display pixels as gradation currents.

48. The drive method of a display device according to claim 47, wherein a signal polarity is set so that the gradation currents flow in a direction from a side of the display pixels.

49. The drive method of a display device according to claim 47, wherein a signal polarity is set so that the gradation currents flow in a direction to a side of the display pixels.

50. The drive method of a display device according to claim 47, further comprising refreshing a charge amount accumulated in the charge storage circuit to a charge amount corresponding to the reference current at each predetermined timing.

51. The drive method of a display device according to claim 47, wherein the display pixels comprise current control type light emitting devices which execute a light generation operation by predetermined luminosity gradations corresponding to the current values of the gradation currents.

52. The drive method of a display device according to claim 51, wherein the light emitting devices comprise organic electroluminescent devices.

53. The drive method of a display device according to claim 51, wherein the changing of the ratio setting of the output currents sets a ratio of the gradation currents relative to the reference current so that the light generation luminosity characteristic between the light emitting devices has a predetermined relationship relative to the current values of the gradation currents in the plurality of display pixels.

54. The drive method of a display device according to claim 51, wherein the light emitting devices of the plurality of display pixels have any of luminescent colors of red, green and blue; and wherein the changing of the ratio setting of the output currents sets a ratio of the gradation currents relative to the reference current in each of the current generation supply circuits so that the light generation luminosity of the luminescent colors red, green and blue of the light emitting devices have a predetermined white balance relative to each gradation value of the display signals.

55. The drive method of a display device according to claim 47, wherein the generating of the output currents includes:

generating a plurality of module currents having a ratio of current values different from each other relative to the reference current corresponding to bit values of the digital signals based on the reference current; and selectively integrating the plurality of module currents corresponding to the bit values of the digital signals held and generating as the output currents.

56. The drive method of a display device according to claim 55, wherein the current values of the plurality of module currents have a different ratio from each other defined by $2^n$, wherein n=0, 1, 2, 3, . . . .

57. The drive method of a display device according to claim 47, wherein the display signals are continuously supplied based on the display signals previously held; and wherein the generating of the output currents supplied to the display pixels and an operation which successively holds the display signals are executed simultaneously in parallel.

58. A current generation supply circuit which supplies drive currents corresponding to digital signals for a plurality of loads comprising:

a plurality of current generation circuits which supply output currents to each of the plurality of loads as the drive currents, each the plurality of current generation circuits comprising:

a reference voltage generation circuit wherein at least a reference current having a constant current value is supplied and the reference voltage generation circuit generating a reference voltage based on the reference current to each of the plurality of loads;

a drive current generation circuit which generates the output currents having a ratio of current values corresponding to the digital signals relative to the reference current based on the reference voltage; and a characteristic control circuit which sets the ratio of the output currents relative to the reference current, wherein the reference voltage generation circuit comprises one reference current transistor into which the reference current flows and which generates the reference voltage corresponding to the reference current, and wherein the characteristic control circuit comprises means for changing the ratio of the output currents of the reference current to each of the plurality of loads by having different transistor sizes for the reference current transistor in the reference voltage generation circuit of each of the current generation circuits.

59. A current generation supply circuit which supplies drive currents corresponding to digital signals for a plurality of loads comprising:

a current generation circuit which supplies output currents to each of the plurality of loads as the drive currents, the current generation circuit comprising:

a reference voltage generation circuit wherein at least a reference current having a constant current value is supplied and the reference voltage generation circuit generating a reference voltage based on the reference current to each of the plurality of loads, and comprising a charge storage circuit which stores electrical charges corresponding to the current value of the reference current;

a drive current generation circuit which generates the output currents having a ratio of current values corresponding to the digital signals relative to the reference current based on the reference voltage; and a characteristic control circuit which sets the ratio of the output currents relative to the reference current.

60. A display device which displays image information corresponding to display signals derived from digital signals comprising:

a display panel comprising a plurality of scanning lines and a plurality of signal lines which intersect perpendicularly with each other and a plurality of display pixels arranged in matrix form near intersecting points of the scanning lines and the signal lines;

a scanning driver circuit which sequentially applies a scanning signal to each of the plurality of scanning lines for setting the plurality of display pixels in a selective state a line at a time; and a signal driver circuit including a plurality of gradation current generation supply circuits which supply output currents as gradation currents to the plurality of display pixels set in the selective state via each of the signal lines, wherein each of the plurality of gradation current generation supply circuits comprises a current generation circuit comprising:

a reference voltage generation circuit wherein at least a reference current having a constant current value is supplied and the reference voltage generation circuit generating a reference voltage based on the reference current to each of the plurality of signal lines, and comprising a charge storage circuit which stores electrical charges corresponding to the current value of the reference current;

a drive current generation circuit which generates the output currents having a ratio of current values corresponding to gradation values of the display signals relative to the reference current based on the reference voltage; and a characteristic control circuit which sets the ratio of the output currents relative to the reference current.

61. A display device which displays image information corresponding to display signals derived from digital signals comprising:

a display panel comprising a plurality of scanning lines and a plurality of signal lines which intersect perpendicularly with each other and a plurality of display pixels that are arranged in matrix form near intersecting points of the scanning lines and the signal lines and that comprise current control type light emitting devices which execute a light generation operation by a luminosity corresponding to a current value of a supplied current;

a scanning driver circuit which sequentially applies a scanning signal to each of the plurality of scanning lines for setting the plurality of display pixels in a selective state a line at a time; and a signal driver circuit including a plurality of gradation current generation supply circuits which supply output currents as gradation currents to the plurality of display pixels set in the selective state via each of the signal lines, wherein each of the plurality of gradation current generation supply circuits comprises a current generation circuit comprising:

a reference voltage generation circuit which includes one reference current transistor wherein at least a reference current having a constant current value is supplied and the reference voltage generation circuit generating a reference voltage based on the reference current to each of the plurality of signal lines;

a drive current generation circuit which generates the output currents having a ratio of current values corresponding to gradation values of the display signals relative to the reference current based on the reference voltage; and a characteristic control circuit which sets the ratio of the output currents relative to the reference current;

wherein the characteristic control circuit in the each of the gradation current generation supply circuits of the signal driver circuit comprises means for changing the ratio of the output currents relative to the reference current by having different transistor sizes for the reference current transistor in each of the gradation current generation supply circuits and for changing the light generation luminosity characteristic between the light emitting devices in the plurality of display pixels.

62. A display device which displays image information corresponding to display signals derived from digital signals comprising:

a display panel comprising a plurality of scanning lines and a plurality of signal lines which intersect perpendicularly with each other and a plurality of display pixels that are arranged in matrix form near intersecting points of the scanning lines and the signal lines and that comprise current control type light emitting devices which execute a light generation operation by a luminosity corresponding to a current value of a supplied current;

a scanning driver circuit which sequentially applies a scanning signal to each of the plurality of scanning lines for setting the plurality of display pixels in a selective state a line at a time; and a signal driver circuit comprising a plurality of gradation current generation supply circuits which supply output currents as gradation currents to the plurality of display pixels set in the selective state via each of the signal lines, wherein each of the plurality of gradation current generation supply circuits comprises a current generation circuit comprising:

a reference voltage generation circuit comprising one reference current transistor wherein at least a reference current having a constant current value is supplied and the reference voltage generating circuit generating a reference voltage based on the reference current to each of the plurality of signal lines;

a drive current generation circuit which generates the output currents having a ratio of current values corresponding to gradation values of the display signals relative to the reference current based on the reference voltage; and a characteristic control circuit which sets the ratio of the output currents relative to the reference current, wherein the light emitting devices of the plurality of display pixels have any of luminescent colors of red, green and blue, and wherein the characteristic control circuit in the each of the gradation current generation supply circuits of the signal driver circuit sets the ratio of the output currents relative to the reference current by having different transistor sizes for the reference current transistor in the reference voltage generation circuit in each of the gradation current generation supply circuits corresponding to each of the luminescent colors red, green, and blue of the light emitting devices so that the light generation luminosity of the luminescent colors red, green, and blue of the light emitting devices have a predetermined white balance in specified gradation values of the display signals.

* * * * *